US009211730B2

(12) United States Patent
Moriyama

(10) Patent No.: US 9,211,730 B2
(45) Date of Patent: Dec. 15, 2015

(54) RECORDING APPARATUS

(71) Applicant: SEIKO EPSON CORPORATION, Tokyo (JP)

(72) Inventor: Ryuji Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/498,740

(22) Filed: Sep. 26, 2014

(65) Prior Publication Data

US 2015/0015656 A1 Jan. 15, 2015

Related U.S. Application Data

(63) Continuation of application No. 12/782,856, filed on May 19, 2010, now Pat. No. 8,909,123.

(30) Foreign Application Priority Data

May 20, 2009 (JP) ..... 2009-122227

(51) Int. Cl.
*B41J 13/00* (2006.01)
*B41J 11/00* (2006.01)
(Continued)

(52) U.S. Cl.
CPC ..... *B41J 11/0045* (2013.01); *B41J 3/60* (2013.01); *B41J 11/04* (2013.01); *B41J 13/0009* (2013.01); *B65H 5/062* (2013.01); *B65H 5/26* (2013.01); *B65H 7/02* (2013.01); *B65H 9/006* (2013.01); *B65H 9/008* (2013.01); *B65H 29/125* (2013.01); *B65H 43/08* (2013.01); *B65H 85/00* (2013.01); *G03G 15/602* (2013.01); *B65H 2301/33312* (2013.01); *B65H 2402/441* (2013.01); *B65H 2404/144* (2013.01); *B65H 2511/11* (2013.01); *B65H 2513/108* (2013.01); *B65H 2801/12* (2013.01)

(58) Field of Classification Search
CPC ..... B41J 13/03; B41J 13/009; B41J 13/0009; B41J 13/0045; B41J 15/10; B41J 15/12; B41J 15/14
USPC ..... 399/401, 402, 361, 381
See application file for complete search history.

(56) References Cited

U.S. PATENT DOCUMENTS 4,958,828 A * 9/1990 Saito ..... 271/186
4,981,380 A * 1/1991 Nishida et al. ..... 400/619
(Continued)

FOREIGN PATENT DOCUMENTS

JP 3-28141 3/1991
JP 08-020140 1/1996
(Continued)

*Primary Examiner* — David Banh
(74) *Attorney, Agent, or Firm* — Workman Nydegger

(57) ABSTRACT

A recording apparatus includes a first transport unit; a second transport unit that is installed in a recording portion side of the downstream from the first transport unit and transports the medium to an upstream side and the downstream side; a first transport path that guides the medium between the first transport unit and the second transport unit; a second transport path that reverses both sides of the medium; and a third transport path that is installed on the second transport path, the second transport unit reversely transports the medium to the upstream side at a transport speed V1 and put it into the second transport path, the transport speed of the third transport unit, which is driven at the transport speed V1, is changed to a transport speed V2 which is higher than the transport speed V1.

4 Claims, 16 Drawing Sheets

(51) Int. Cl.

| | |
|---|---|
| ***B41J 3/60*** | (2006.01) |
| ***B65H 5/06*** | (2006.01) |
| ***B65H 5/26*** | (2006.01) |
| ***B65H 7/02*** | (2006.01) |
| ***B65H 9/00*** | (2006.01) |
| ***B65H 29/12*** | (2006.01) |
| ***B65H 43/08*** | (2006.01) |
| ***G03G 15/00*** | (2006.01) |
| ***B65H 85/00*** | (2006.01) |
| ***B41J 11/04*** | (2006.01) |

(56) References Cited

U.S. PATENT DOCUMENTS

| | | | | |
|---|---|---|---|---|
| 5,000,598 | A * | 3/1991 | Jingu et al. | 400/642 |
| 5,055,885 | A * | 10/1991 | Yoshikado et al. | 399/401 |
| 5,427,462 | A * | 6/1995 | Jackson et al. | 400/579 |
| 6,374,077 | B1 * | 4/2002 | Hirai et al. | 399/407 |
| 6,411,795 | B2 * | 6/2002 | Okamoto | 399/401 |
| 6,727,933 | B2 * | 4/2004 | Fisher | 347/217 |
| 7,033,014 | B2 * | 4/2006 | Ohashi et al. | 347/104 |
| 7,079,805 | B2 * | 7/2006 | Suzuki | 399/401 |
| 7,467,790 | B2 * | 12/2008 | Westhoff | 271/3.14 |
| 7,515,866 | B2 * | 4/2009 | Togashi et al. | 399/381 |
| 7,793,927 | B2 * | 9/2010 | Lin | 271/3.14 |
| 7,992,993 | B2 * | 8/2011 | Hiroki et al. | 347/106 |
| 2002/0051665 | A1 * | 5/2002 | Seto et al. | 399/388 |
| 2002/0061215 | A1 * | 5/2002 | Kamei | 399/401 |
| 2003/0063936 | A1 * | 4/2003 | Sasaki et al. | 399/401 |
| 2003/0175060 | A1 * | 9/2003 | Suzuki | 399/401 |
| 2004/0213610 | A1 * | 10/2004 | Yuasa | 399/401 |
| 2005/0254871 | A1 | 11/2005 | Kim | |
| 2005/0254872 | A1 * | 11/2005 | Nonaka et al. | 399/401 |
| 2005/0270354 | A1 | 12/2005 | Taguchi et al. | |
| 2006/0204264 | A1 * | 9/2006 | Yasui et al. | 399/68 |
| 2006/0239734 | A1 * | 10/2006 | Ohtsuki | 399/401 |
| 2007/0020001 | A1 | 1/2007 | Tanabe | |
| 2007/0122225 | A1 | 5/2007 | Izuchi et al. | |
| 2008/0056790 | A1 * | 3/2008 | Maruyama | 399/395 |
| 2008/0187381 | A1 * | 8/2008 | Ahn et al. | 399/397 |

FOREIGN PATENT DOCUMENTS

| | | |
|---|---|---|
| JP | 2003-201069 | 7/2003 |
| JP | 2006-298605 | 11/2006 |

* cited by examiner

RECORDING APPARATUS

CROSS-REFERENCE TO RELATED APPLICATIONS

This application is a continuation application of U.S. patent application Ser. No. 12/782,856, filed May 19, 2010, which patent application is incorporated herein by reference in its entirety. U.S. patent application Ser. No. 12/782,856 claims the benefit of Japanese Patent Application No. 2009-122227 filed May 20, 2009, the contents of which is also hereby incorporated by reference in its entirety.

BACKGROUND

1. Technical Field

The present invention relates to a recording apparatus which includes a transport unit that transports a medium to be recorded in a transport direction and a transport path that reverses both sides of the medium to be recorded which is transported by the transport unit.

In the invention, the recording apparatus includes various kinds of apparatuses such as an ink jet printer, a wire dot printer, a laser printer, a line printer, a copier, a facsimile or the like.

2. Related Art

In a related art, as described in JP-A-2006-298605, a recording apparatus has included a roller as a transport unit and a reverse path as a transport path. Among them, the roller has been installed such that it can transport a paper, which is an example of the medium to be recorded, in a transport direction. In addition, the roller has been installed such that it can be driven by the use of the power of a motor installed in the recording apparatus.

Furthermore, the reverse path has been formed in a ring shape when seen from a side thereof and has been installed such that it guides the paper to be transported by the roller and can reverse both sides of the paper. Thus, the recording apparatus could reverse both sides of the paper in which the recording of the front surface has been finished in the reverse path. In addition, by returning the reversed paper by the roller, the recording could be executed with respect to the rear surface of the paper. It is a so-called double-sided printing. Furthermore, after a front surface of a first paper has been recorded, both sides have been reversed to record the rear surface thereof, and continuously after a front surface of a second paper has been recorded, both sides have been reversed to record a rear surface thereof.

However, the roller of the recording apparatus had a structure that has been driven by the use of the power of the motor which is a power source of the other roller. Thus, it has been difficult to control the roller independently of the other roller. In other words, it has been difficult to independently change the driving speed of the roller. In addition, in order to make the apparatus itself as small as possible, the length of the reverse path has been installed to match with the length of the maximum size of the recordable paper.

Herein, in case of a paper having a length smaller than the length of the maximum size, the distance of the paper transported in order to reverse both sides of the paper in the reverse path is the same as in case of the paper having the maximum size.

Thus, the time from when the recording to the front surface of the paper has been completed to when the recording to the rear surface of the paper is performed is increased to the extent that the length of the paper is short. Namely, to the extent that the length of the paper is short, an unnecessary movement distance is increased, therefore the time from the completion of the recording to the one surface to the start of the recording to the other surface is lengthened, thereby resulting in a large loss of the time. Furthermore, even when the length of the paper is relatively short, consequently, a so-called throughput, which is a use time from the start of the recording to the discharging per a sheet of paper, may not be improved.

SUMMARY

An advantage of some aspects of the invention is to provide a recording apparatus that considers the loss of time from completion of the recording on the one surface of a medium to the start of the recording on the other surface of the recording apparatus for executing double-sided printing.

The first aspect of the above mentioned recording apparatus of the invention includes a first transport unit that transports a medium to be recorded to a downstream side in a transport direction, a second transport unit that is installed in a recording portion side of the downstream in the transport direction at the time of recording from the first transport unit and transports the medium to be recorded to the upstream side and the downstream side in the transport direction at the time of printing, a first transport path that guides the medium to be recorded between the first transport unit and the second transport unit, a second transport path that reverses both sides of the medium to be recorded, and a third transport path that is installed on the second transport path, driven by a first motor and transports the medium to be recorded, after a first surface of the medium to be recorded has been recorded by the recording portion, the second transport unit reversely transports the medium to be recorded to the upstream side in the transport direction at the time of recording at a transport speed V1 and put it into the second transport path, according to the length of the medium to be recorded, after a rear end of the medium to be recorded in the transport direction has passed through the second transport unit, the transport speed of the third transport unit, which is being driven at the transport speed V1, is changed to a transport speed V2 higher than the transport speed V1, and the third transport unit has a first mode that transports the medium to be recorded from a retreated side, which is opposite side of the side put into the second transport path, to the recording portion side.

According to the first aspect of the invention, after the first surface of the medium to be recorded on has been recorded on the recording portion, the medium to be recorded is reversely transported to the upstream side in the transport direction at the time of recording and enters into the second transport path. At this time, the transport speed of the first roller, which is being driven at the transport speed V1, can be changed to a transport speed V2 higher than the transport speed V1, according to the length of the medium to be recorded. Thus, the time from the completion of the recording of the first surface to the start of the recording to the second surface, which is the rear surface when the first surface is assumed to be the front surface, can be reduced as compared to a case where the transport speed is not changed to the second speed V2.

For example, according to the length of the medium to be recorded, the transport speed can be divided into a case where the length of the medium to be recorded is shorter than the length of the second transport path and a case where the length of the medium to be recorded is longer than the length of the second transport path. In addition, in case of the short length, by taking the transport speed V2, the time can be further reduced. In particular, it is effective to the extent that the length of the medium to be recorded is short. On the other hand, in case of the long length, since there is no distance by which the transport speed is accelerated to V2, both sides are reversed with the transport speed V1 and are again transported to the recording portion.

In addition, the driving speed of the first motor is set to be a high speed so that it is changed from the transport speed V1 to the transport speed V2. Thus, the structure of the embodiment can obtain the above-described working effects with low costs as compared to a structure in which the second transport path is branched into a plurality of paths, the lengths of the paths are different from each other, and the medium to be recorded is distributed to the branched path according to the length of the medium to be recorded. That is to say, it is possible to reduce a loss of time and improve the throughput.

According to a second aspect of the invention, in the first aspect of the invention, a roller pair, which is driven by a second motor and is capable of being separated from each other, is installed between the retreated side of the second transport path in the first transport path and the second transport unit, the recording apparatus has the first mode which is executed in a case where the length of the medium to be recorded is shorter than a path length L between the downstream side in the transport direction of the third transport unit and the second transport unit, and a second mode which is executed in a case where the length of the medium to be recorded is longer than the path length L, when the third transport unit retreats the medium to be recorded from the retreated side of the second transport path to the first transport path and transport it to the recording portion side, the first mode makes the roller pair approach to each other, the roller pair transports the medium to be recorded, which has been retreated from the retreated side of the second transport path, to the second transport unit of the recording portion side, the second mode makes the roller pair separate from each other, and the third transport unit transports the medium to be recorded, which has been retreated from the retreated side of the second transport path, to the second transport unit of the recording portion side.

According to the second aspect of the invention, in addition to the same working effects as the first aspect, in a case where the length of the medium to be recorded is shorter than the path length L, in the first mode, it is possible to securely transport the medium to be recorded by the roller pair to the second transport unit. That is to say, a so-called jam in which the medium to be recorded is congested in the first transport path does not occur.

On the other hand, in a case where the length of the medium to be recorded is longer than the path length L, the roller pairs are separated from each other by the second mode. Thus, a section where the medium to be recorded is transported at the transport speed V2 can be increased as compared to a state in which the roller pair is not separated from each other. As a consequence, it is possible to reduce the time from the completion of the recording of the first surface to the start of the recording of the second surface. Namely, it is possible to reduce a so-called throughput which is a time that is necessary from the start of the feeding per one sheet to the completion of double-sided recording.

According to a third aspect of the invention, in the first or second aspect, a roller pair, which is driven by the second motor and is capable of being separated from each other, is installed between the retreated side of the second transport path in the first transport path and the second transport unit, the recording apparatus further has a third mode in addition to the first mode, when the third transport unit retreats the medium to be recorded from the retreated side of the second transport path to the first transport path and transports it to the recording portion, the first mode drives the roller pair at the transport speed V1 in a state in which the roller pair are approached each other, and change the transport speed of the third transport unit from V2 to V1, before the front end in the movement direction of the medium to be recorded reaches the roller pair, the third mode drives the roller pair at the transport speed V1 in a state in which the roller pair are separated from each other, drives the third transport unit at the transport speed V2 until the rear end of the movement direction of the medium to be recorded passes through the third transport unit, and makes the roller pair approach to each other after the front end of the movement direction of the medium to be recorded has passed through the roller pair.

According to the third aspect of the invention, in addition to the working effects of the first or second aspect, in the first mode, it is possible to transport the medium to be recorded to the recording portion by means of the roller pair which is synchronous with each other at the transport speed V1 and the third transport unit. As a result, there is no fear that the roller pair damages the medium to be recorded.

On the other hand, in the third mode, after the front end of the movement direction of the medium to be recorded, which moves at the transport speed V2, has passed through the roller pair, the pair of roller is approached to each other so as to transport the medium to be recorded to the recording portion side at the transport speed V1. Thus, it is possible to make a section where the medium to be recorded moves at the transport speed V2 longer as compared to the case of the first mode. As a consequence, it is possible to further reduce the time from the completion of the recording of the first surface to the start of the recording of the second surface as compared to the case of the first mode.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described on the basis of the accompanying drawings.

Figure 1:
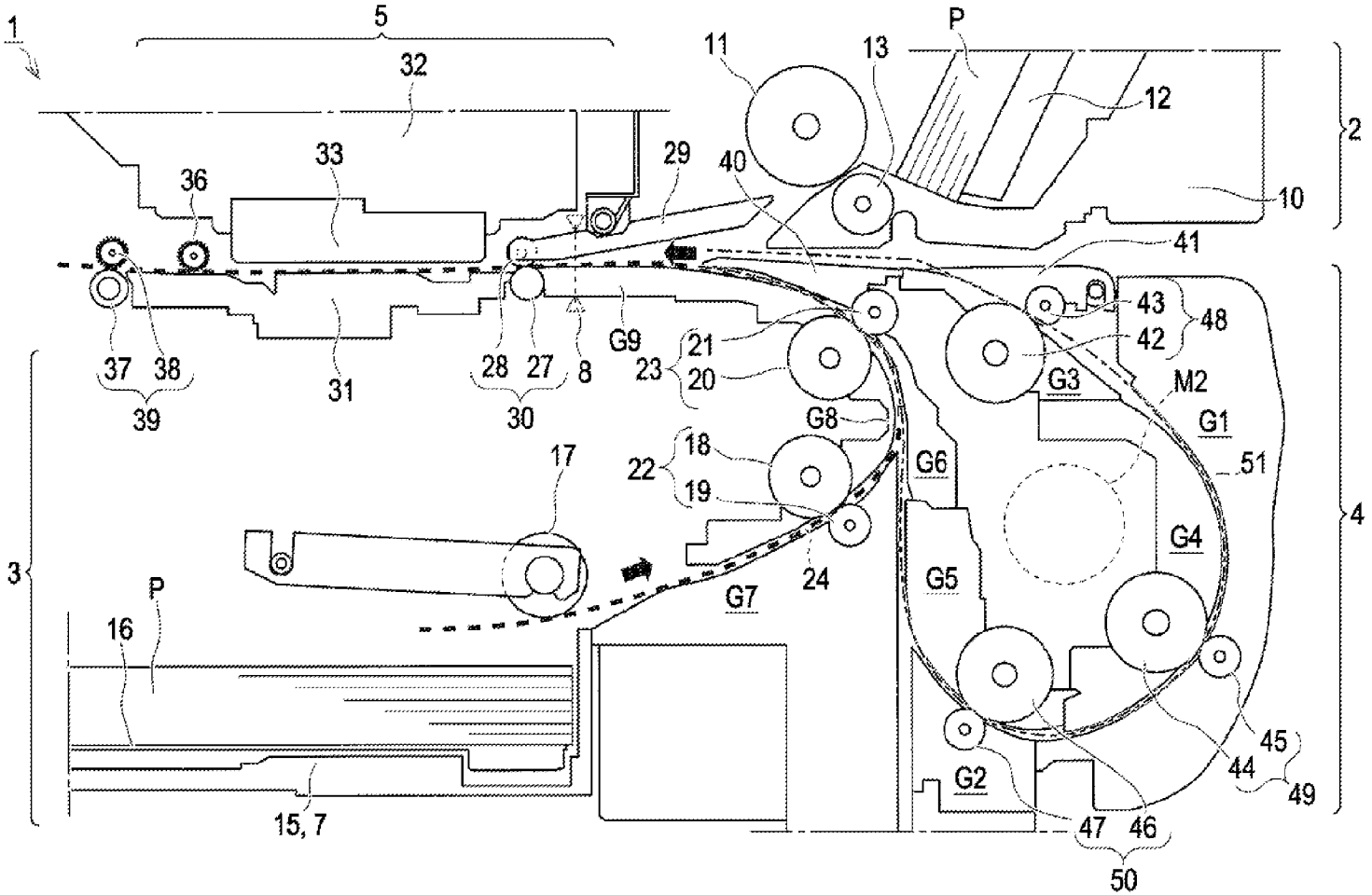
FIG. 1 is a schematic side view showing an inner part of a printer according to the invention.

FIG. 1 is a schematic side view that shows an outline of an inner part of an ink jet printer (hereinafter, referred to as "printer") 1 as an example of a "recording apparatus" or a "liquid ejecting apparatus" according to an aspect of the invention.

Herein, the liquid ejecting apparatus is not limited to recording apparatuses such as an ink eject-type recording apparatus, a copier and a facsimile or the like which eject ink from a recording head as a liquid ejecting head to a medium to be recorded such as a recording paper to perform recording to a material to be recorded, but is used in the meaning of including an apparatus that ejects a liquid corresponding to a particular use instead of ink from a liquid ejecting head corresponding to the above-described recording head to a material to be ejected corresponding to the material to be recorded and attaches the liquid to the material to be ejected.

In addition, as the liquid ejecting head, in addition to the above-described recording head, there may be included a color material ejecting head which is used for manufacturing a color filter such as a liquid crystal display, an electrode material (conductive paste) ejecting head which is used for forming electrodes such as an organic EL display and a face emitting display (FED), a bio organic matter ejecting head which is used for manufacturing a bio chip, and a sample ejecting head for ejecting a sample as a micro pipette or the like.

As shown in FIG. 1, the printer 1 includes a rear feeding portion 2, a front feeding portion 3, a reverse transporting portion 4, a recording portion 5, a discharging portion (not shown), and a controlling portion 6.

Among them, the rear feeding portion 2 is configured such that it can transport a paper P from behind of the printer 1 to the recording portion 5. Specifically, the rear feeding portion 2 includes a base frame 10, a paper feeding roller 11, a first hopper 12 and a retard roller 13.

Furthermore, the first hopper 12 is installed such that the paper P is mounted thereon. The first hopper 12 is installed such that it can move toward and away from the paper feeding roller 11 in the base frame 10.

In addition, the paper feeding roller 11 is installed such that it can be driven by the power of a motor which is not shown.

Furthermore, in a state in which the first hopper 12 approaches the paper feeding roller 11, the paper feeding roller 11 can transport the uppermost paper P with respect to the paper feeding roller 11 among the papers P mounted on the first hopper 12, to the downstream side in the transport direction. Herein, the retard roller 13 is installed such that it requires a predetermined load for rotation. Thus, when a plurality of papers P is to be transported by the paper feeding roller 11, it is possible to separate the next excess papers from the uppermost paper.

In addition, the front feeding portion 3 is configured such that it can reverse the paper P from the bottom of the front of the printer 1 on a U shape when seen from a side and transport the paper P to the recording portion 5. Specifically, the front feeding portion 3 has a cassette portion 15 which is an example of a mounting portion 7, a pickup roller 17, a first feeding roller pair 22, a second feeding roller pair 23, and a paper guide path 24. Among them, the cassette portion 15 has a second hopper 16 capable of mounting the paper P thereon. The second hopper 16 is installed such that it can move toward and away from the pickup roller 17.

In addition, the pickup roller 17 is installed such that it can be driven by the power of a first motor M1 (see FIGS. 2 to 11). Thus, in a state in which the second hopper 16 approaches the pickup roller 17, the pickup roller 17 can transport the uppermost paper P with respect to the pickup roller 17, to the downstream side in the transport direction.

In addition, of course, the pickup roller 17 may be conceptionally configured as a part of the mounting portion 7.

In addition, the first feeding roller pair 22 is installed such that it can further transport the paper P, which has been transported by the pickup roller 17, to the downstream side in the transport direction. Specifically, the first feeding roller pair 22 has a first feeding driving roller 18 and a first feeding driven roller 19. Among them, the first feeding driving roller 18 is installed such that it can be driven by the power of the first motor M1.

On the other hand, the first feeding driven roller 19 is installed such that it can be rotated according to the rotation of the first feeding driving roller 18.

In addition, the first feeding driving roller 18 is installed such that it can move toward and away from the first feeding driven roller 19 by means of the power of a fourth motor M4 (see FIGS. 2 to 11).

Furthermore, a mechanism, which moves toward and away from the first feeding driven roller 19, may be configured, for example, by a planetary gear mechanism. In addition, of course, a structure in which the first feeding driven roller 19 moves toward and away from the first feeding driving roller 18 may be considered.

In addition, the second feeding roller pair 23 is installed such that it can further transport the paper P, which has been transported by the first feeding roller pair 22, to the downstream side in the transport direction. Specifically, similar to the above-described first feeding roller pair 22, the second feeding roller pair 23 has a second feeding driving roller 20 and a second feeding driven roller 21. Among them, the second feeding driving roller 20 is installed such that it can be driven by the power of the first motor M1. On the other hand, the second feeding driven roller 21 is installed such that it can be rotated according to the rotation of the second feeding driving roller 20.

In addition, the second feeding driving roller 20 is configured such that it can move toward and away from the second feeding driven roller 21 by means of the power of the fourth motor M4. Furthermore, a structure in which the second feeding driven roller 21 moves toward and away from the second feeding driving roller 20 may be considered.

In addition, the paper guide path 24 is configured such that it can guide the paper P from the mounting portion 7 to the recording portion 5. Specifically, the paper guide path 24 includes guide members G6 to G9, an upper guide member 29 and a first flap 40.

In addition, a reverse transporting portion 4 is detachably installed in the printer main body.

Herein, the printer main body refers to a portion except for the reverse transporting portion 4 in the printer 1.

In addition, the reverse transporting portion 4 is configured such that it can reverse both sides of the paper P in which one surface of the paper P in the recording portion 5 has been recorded and transport the paper P to the recording portion 5 again. Specifically, the reverse transporting portion 4 has a first reverse roller pair 48, a second reverse roller pair 49, a third reverse roller pair 50, a second motor M2, and a reverse path 51.

Among them, the first reverse roller pair 48 is installed such that it can transport the paper P, which has been reversely transported to the upstream side (a direction which is opposite to a direction of an arrow of a Y axis) in the transport direction at the time of recording from the recording portion 5, to the second reverse roller pair side in the reverse path 51. Specifically, the first reverse roller pair 48 has a first reverse roller 42 which is driven by the power of the second motor M2 and a first driven roller 43 which rotates according to the rotation of the first reverse roller 42.

In addition, the second reverse roller pair 49 is installed such that it can transport the paper P, which has been transported from the first reverse roller pair 48, to the third reverse roller pair side. Specifically, similar to the above-described first reverse roller pair 48, the second reverse roller pair 49 has a second reverse roller 44, which is driven by the power of the second motor M2, and a second driven roller 45 which rotates according to the rotation of the second reverse roller 44.

Furthermore, the third reverse roller pair 50 is installed such that it can transport the paper P which has been transported from the second reverse roller pair 49 to the recording portion side. Specifically, similar to the above-described first reverse roller pair 48, the third reverse roller pair 50 has a third reverse roller 46, which is driven by the power of the second motor M2, and a third driven roller 47 which rotates according to the rotation of the third reverse roller 46.

In addition, the reverse path 51 is formed in a ring shape when seen from the side thereof and is connected to the paper guide path 24. Specifically, the reverse path 51 is formed in a ring shape when seen from the side thereof by means of the guide members G1 to G8, the first flap 40 and the second flap 41.

In addition, the first flap 40 is installed such that it can roll by its own weight. On the other hand, the second flap 41 is installed such that it can roll by the power of a motor which is not shown.

In addition, the recording portion 5 is configured such that it can discharge the ink to the paper P to perform the recording. Specifically, the recording portion 5 includes a carriage 32, a recording head 33, a bottom guide member 31 and a carriage motor which is not shown. Among them, the carriage 32 is installed such that it can move in the width direction X of the paper P by the power of the carriage motor while being guided to a guide portion (not shown) which extends in the width direction X of the paper P. In addition, the recording head 33 is installed in the bottom side of the carriage 32 and is configured such that it can discharge the ink to the paper P. In addition, the bottom guide member 31 is installed such that it can support the paper P from the down side in a position which is opposite to the recording head 33.

In addition, in the vicinity of the upstream side in the transport direction of the recording portion 5 at the time of recording, the transport roller pair 30 is installed. The transport roller pair 30 is installed such that it can transport the paper P to the upstream side and the downstream side in the transport direction at the time of recording. Specifically, the transport roller pair 30 has a transport driving roller 27 which is driven by the power of the third motor M3 (see FIGS. 2 to 11), and the transport driven roller 28 which rotates according to the rotation of the transport driving roller 27.

In addition, in the vicinity of the downstream side in the transport direction of the recording portion 5 at the time of recording, a discharging roller pair 39 and a discharging assistant roller 36 are installed. The discharging roller pair 39 is installed such that it can transport the paper P to the upstream side and the downstream side in the transport direction at the time of recording. Specifically, the discharging roller pair 39 has a discharging driving roller 37 which is driven by the power of the third motor M3, and the discharging driven roller 38 which rotates according to the rotation of the discharging driving roller 37.

In addition, in order not to contact the paper P with the recording head 33, the discharging assistant roller 36 is installed between the recording head 33 and the discharging roller pair 39 in the transport direction Y.

Furthermore, the transport roller pair 30 and the discharging roller pair 39 may be conceptionally configured as a part of the recording portion 5.

In addition, the discharging portion (not shown) is installed such that it can mount the paper P in which the recording has been completed. Specifically, the discharging portion has a discharging tray (not shown) that can pile up the paper P which has been discharged by the discharging roller pair 39.

In addition, the controlling portion 6 is installed such that it can control the first motor M1, the second motor M2, the third motor M3, the fourth motor M4, the carriage motor and the recording head 33. In addition, at the time of double-sided recording mode that performs the recording with respect to the both sides of the paper P, it is configured such that the "normal transport mode" or the "first transport time reduction mode" is performed according to the length of the paper P.

Herein, the "normal transport mode" refers to a mode in which the front surface of the paper P is recorded, the paper P is transported to the reverse transporting portion 4 at a regular speed, both sides thereof are reversed while being transported at the regular speed, and the rear surface is recorded by means of the recording portion 5. On the other hand, in the "first transport time reduction mode", the front surface of the paper P is recorded and the paper P is transported to the reverse transporting portion 4 at the regular speed. In addition, the first transport time reduction mode refers to a mode in which the transporting speed is switched to the high speed, both sides thereof are reversed while the paper P is transported, the transporting speed is reduced to the original speed in front of the recording portion 5 and the rear surface of the paper P is recorded with the recording portion 5.

In addition, in the printer 1 of an embodiment of the invention, the length of the paper of the maximum size capable of being fed is slightly shorter than the path length from the position of the sensor 8 via the reverse path 51 again to the position of the sensor 8. In addition, the length of the paper of the minimum size capable of being feed is slightly longer than the path length from the third reverse roller pair 50 to the second feeding roller pair 23. Herein, the path length between the roller pair and the roller path is such that the path length between the third reverse roller pair 50 and the second feeding roller pair 23 is the shortest.

In succession, the operation of the "first transport time reduction mode" of an embodiment of the invention will be described.

Figure 2:
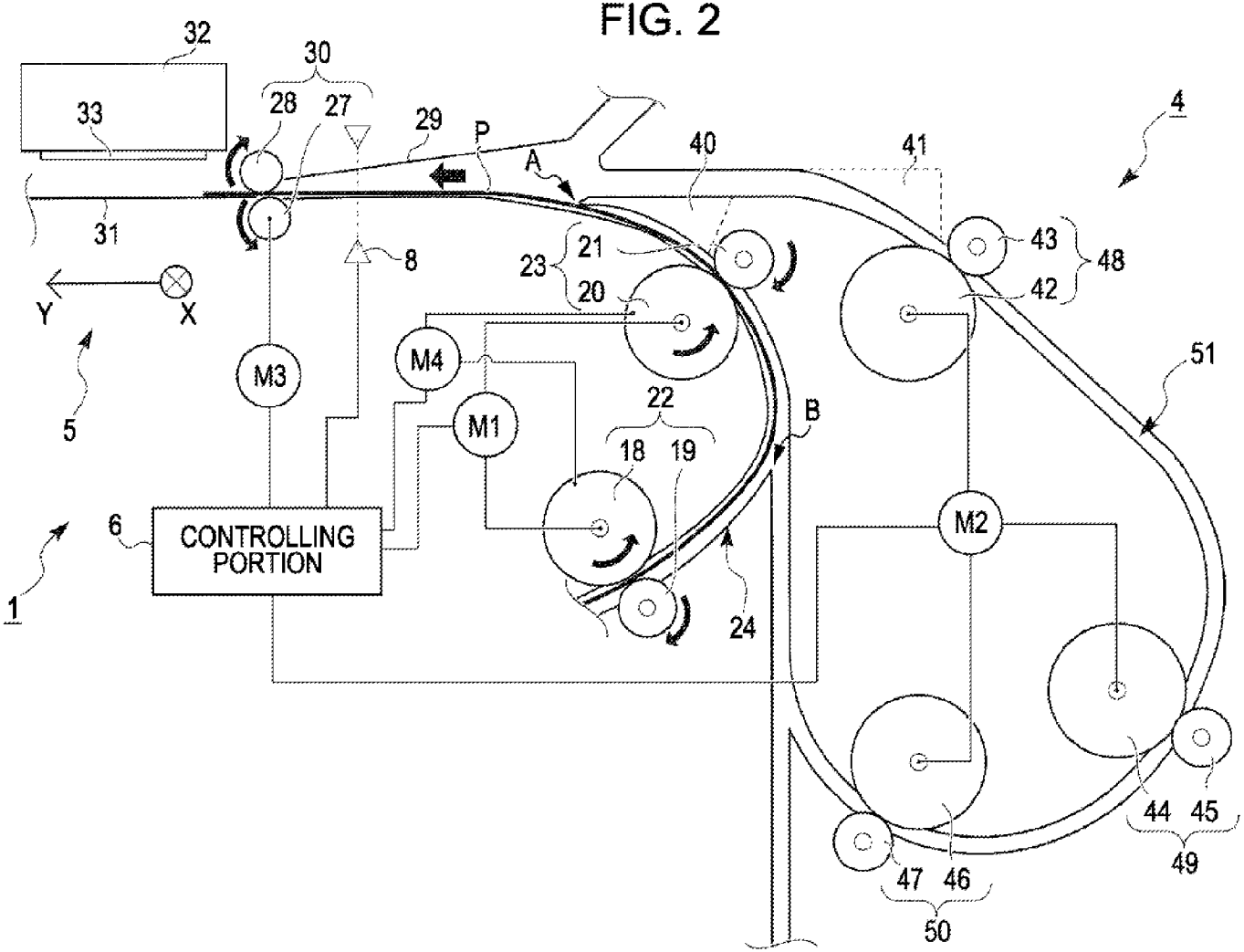
FIG. 2 is a diagram that shows a state in which the printer detects a front end of a paper and transports it to a recording start position.

FIG. 2 is a schematic side view that shows the time when the printer according to an embodiment of the invention transports the paper.

As shown in FIG. 2, in the upstream side in the transport direction at the time of recording from the transport driving roller 27 on the paper guide path, the sensor 8 is installed. The sensor 8 detects the front end and the rear end of the paper P and is installed such that it can send the detection signals to the controlling portion 6.

In addition, the sensor 8 may be a non-contact type sensor with a light emitting element and a light receiving element, and may be a contact type sensor in which the lever comes in contact with the paper and rolls, thereby detecting the paper.

In addition, when the double-recording mode is selected, the second flap 41 rolls upward by means of the power of a motor (not shown). As a consequence, the reverse path 51 of a ring shape when seen from the side thereof is formed.

When the command for the recording perform is input into the controlling portion 6, the paper P mounted on the cassette portion 15 is picked up by the pickup roller 17 and is transported to the downstream side in the transport direction. The picked up paper P is further transported to the downstream side in the transport direction by means of the first feeding roller pair 22.

In addition, when the paper P is transported to the downstream side in the transport direction, the paper P is further transported to the downstream side in the transport direction by means of the second feeding roller pair 23. Furthermore, the front end of the paper P passes through the sensor 8. At this time, the controlling portion 6 is configured such that it can receive the detection signals from the sensor 8 to recognize the front end of the paper P. Furthermore, when the paper P is transported to the downstream side in the transport direction, the front end of the paper P reaches the transport roller pair 30.

At this time, by causing the paper P to be bent between the transport roller pair 30 and the second feeding roller pair 23, the front end of the paper P is pressed in a nip line of the transport roller pair 30.

Herein, the "nip line" refers to a line-shaped circumscription place that is formed by the mutual circumscription of the roller pair. The posture of the nip line is in the vertical relationship with the transport direction.

In addition, a so-called skew adjustment is performed in which the posture of one side of the front end side of the paper P is made to accord the posture of the nip line of the transport roller pair 30 so as to straighten the inclined posture of the paper P with respect to the transport direction.

In addition, the skew adjustment may be any way of so-called a "reverse rotation protruding way" a "protruding way" and a "snap discharging way".

Herein, the "reverse rotation protruding way" causes the front end of the paper P to protrude into the transport roller pair 30 which is driven for the reverse rotation, thereby bending the paper P. Furthermore, the "reverse rotation protruding way" refers to a way which makes the one side of the front end of the paper P accord to the nip line by the use of the force generated by the bending of the paper P, thereby performing the skew adjustment.

In addition, the "protruding way" causes the front end of the paper P to protrude into the transport roller pair 30 which is in the stopped state, thereby bending the paper P. Furthermore, the "protruding way" refers to a way which makes the one side of the front end of the paper P accord to the nip line by the use of the force generated by the bending of the paper P, thereby performing the skew adjustment.

In addition, the "snap discharging way" causes the front end of the paper P to be once pinched into the transport roller pair 30 which is driven for the forward rotation, thereby causing the snapping. Thereafter, the transport roller pair 30 is reversely transported to the upstream side so that it discharges the front end of the paper P while being driven for the reverse rotation causing the paper P to become bent. In addition, the "snap discharging way" refers to a way which makes the front end of the paper P accord to the nip line by the use of the force generated by the bending of the paper P, thereby performing the skew adjustment.

Thereafter, by means of the transport roller pair 30, the front end of the paper P is transported to a position which is opposite to the upstream side of the recording head 33 in the transport direction Y. It is a so-called a marker that transports the front end up to the recording start position. Furthermore, the paper P is recorded by the recording head 33 while being transported to the downstream side in the transport direction by means of the transport roller pair 30, the second feeding roller pair 23 and the first feeding roller pair 22. That is to say, the front surface of the paper P is recorded.

Herein, a surface to be recorded in advance in the paper P is called as the front surface. Furthermore, a surface to be recorded later is called as the rear surface.

In addition, when the paper P is transported to the downstream side in the transport direction by the transport roller pair 30, the second feeding driving roller 20 and the first feeding driving roller 18 may be each separated and moved from the second feeding driven roller 21 and the first feeding driven roller 19 due to the power of the fourth motor M4. Namely, it may be a structure in which the paper P is transported only by the transport roller pair 30. This is because it is possible to transport the paper P at a high degree of accuracy even in a related case.

Figure 3:
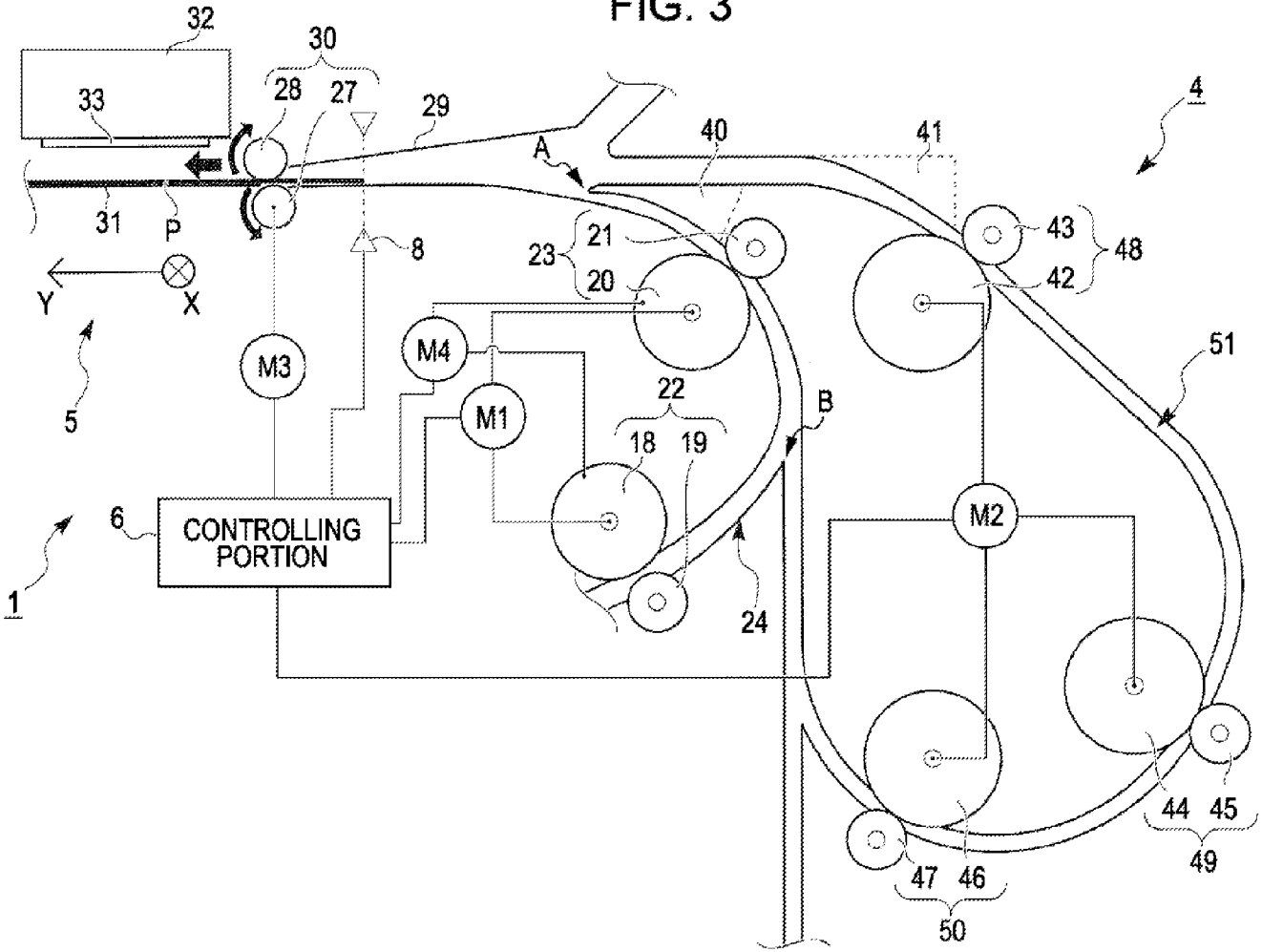
FIG. 3 is a diagram that shows a state in which the printer according to the invention detects a rear end of a front surface of a paper.

FIG. 3 is a schematic side view that shows a state when the printer according to an embodiment of the invention detects the rear end of the front surface of the paper.

As shown in FIG. 3, if the paper P is further transported from the state shown in FIG. 2 to the downstream side in the transport direction at the time of recording, the rear end of the paper P passes through the sensor 8. The controlling portion 6 is hereby configured such that it can detect the change in signals from the sensor 8 to recognize the rear end of the paper P.

In addition, the controlling portion 6 is configured such that it can calculate the distance of the paper P transported by the second transporting roller pair and the transport roller pair 30 from when the front end of the paper P has been detected and to when the rear end of the paper P is detected. This enables the length (size) of the paper P to be identified.

In addition, in a case where the transported distance of the paper P becomes larger than a predetermined value, the controlling portion 6 is installed such that it can judge that the paper decrease occurs in the transport path to display an error. It is a so-called jam judgment.

Figure 4:
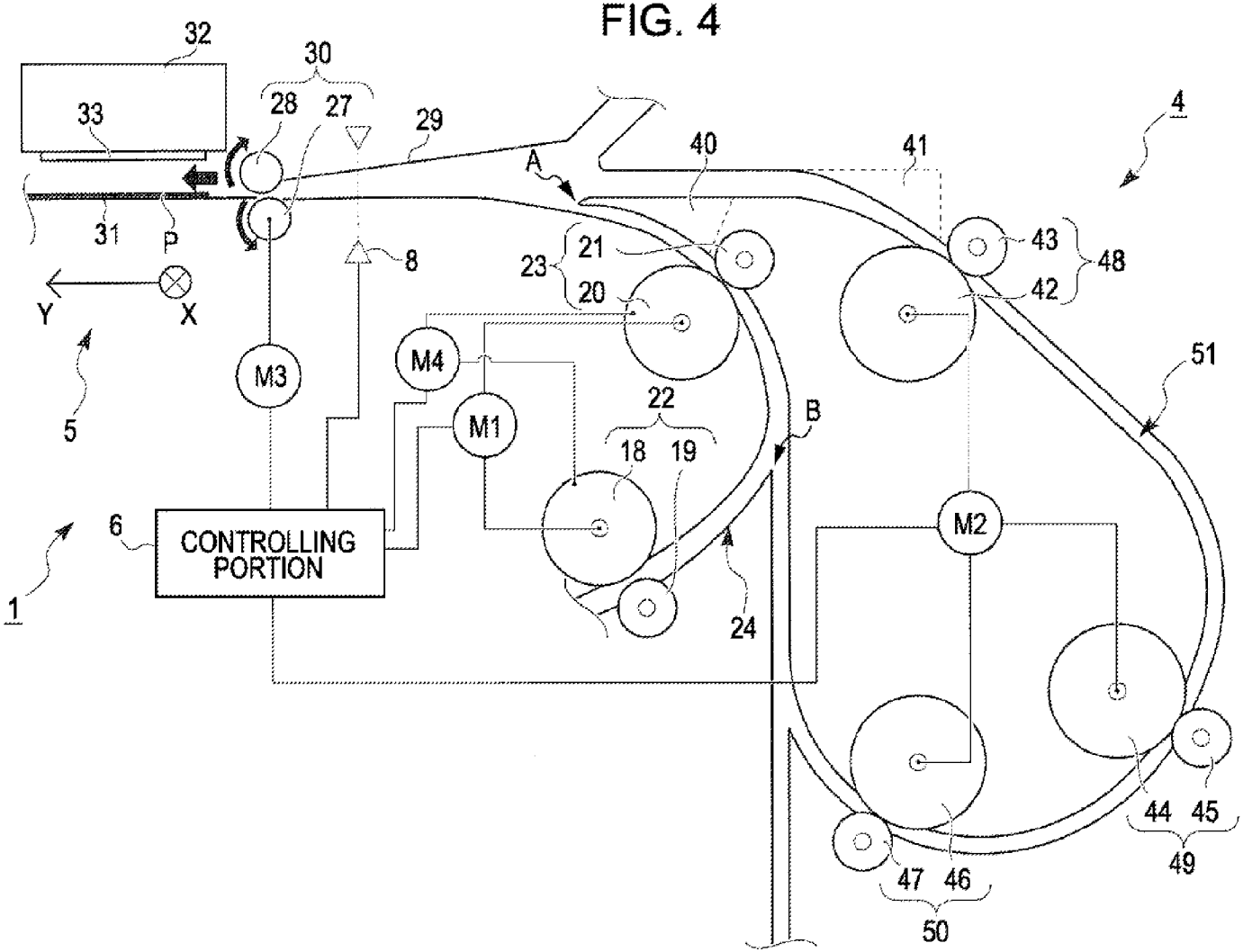
FIG. 4 is a diagram that shows a state in which the printer according to the invention has completed the recording of the front surface of the paper.

FIG. 4 is a schematic side view that shows a state when the printer according to an embodiment of the invention has completed the record of the front surface of the paper.

As shown in FIG. 4, the paper P is transported from the state shown in FIG. 3 to the downstream side in the transport direction at the time of recording, and the record of the rear end side in the front surface of the paper P is completed. At this time, the rear end of the paper P is positioned in the downstream side in the transport direction at the time of recording from the transport roller pair 30. Furthermore, the record is completed while the paper P is transported by the above-described discharging roller pair 39.

Herein, between when the rear end of the paper P has been detected and when the record of the front surface of the paper P has been completed, the controlling portion 6 is configured so as to compare the length of the paper P obtained by the calculation with a length which enters from the position of the sensor 8 into the reverse transport path further than the connection point A through the connection point B to the second feeding roller pair 23.

In addition, of course, the length information of the paper P may use information of the paper size input in the setting of the printer 1 by the user, in addition to information obtained by the above-describe calculation.

In addition, in a case where the controlling portion 6 judges that the length of the paper P is shorter than the length that enters from the position of the sensor 8 into the reverse transport path further than the connection point A through the connection point B to the second feeding roller pair 23, the "first transport time reduction mode" to be described later is performed. This is for the purpose of reducing the loss of time from the record completion to one surface to the record start to another surface.

On the other hand, in a case where the controlling portion 6 judges that the length of the paper P is longer than the length that enters from the position of the sensor 8 into the reverse transport path further than the connection point A through the connection point B to the second feeding roller pair 23, the "normal transport mode" is performed. This is because the paper P cannot be accelerated in the reverse path 51.

Herein, the "normal transport mode" reversely transports the paper P to the upstream side in the transport direction at the time of recording of the paper P at the regular speed after the recording to the front surface of the paper P has been completed, and makes the paper P enter from the connection point A to the reverse path 51. Furthermore, the "normal transport mode" refers to a mode in which both sides thereof are reversed while the paper P is transported at the regular speed, the paper is returned from the connection point B to the paper guide path 24 and is transported to the downstream side (a direction of an arrow of Y axis) in the transport direction at the time of recording, so as to perform the record to the rear surface of the paper P. Namely, it refers to a mode in which the paper is transported at the regular speed from when the record to the front surface has been completed to when the paper is transported to the reverse transporting portion 4 and is again transported to the recording portion 5.

Figure 5:
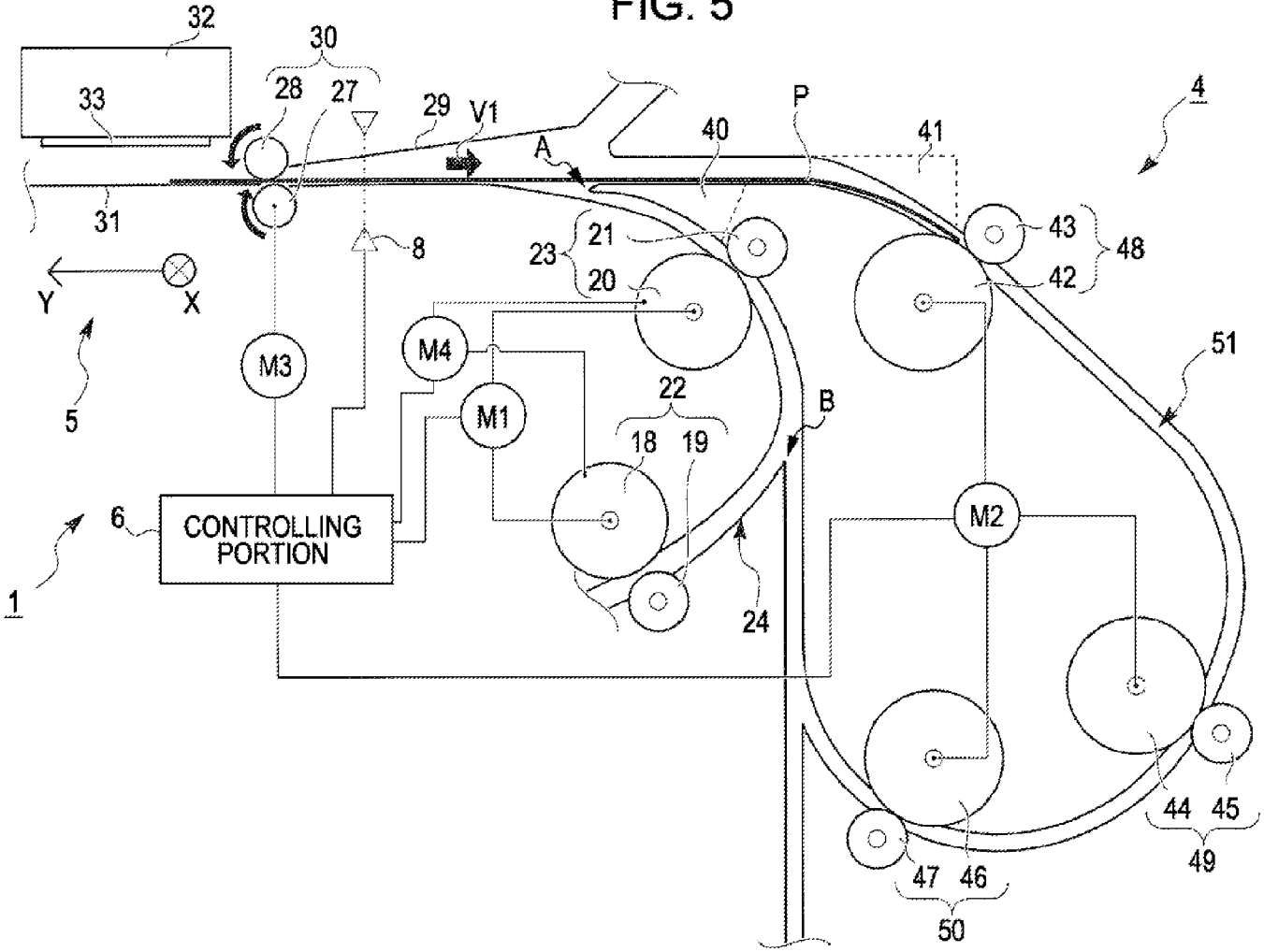
FIG. 5 is a diagram that shows a state in which the printer according to the invention reversely transports the paper.

FIG. 5 is a schematic side view that shows a state in which the printer according an embodiment of the invention reversely transports the paper.

As shown in FIG. 5, in a case where the "first transport time reduction mode" is performed, the discharging roller pair 39 and the transport roller pair 30 is driven for the reverse rotation from the state shown in FIG. 4 so as to reversely transport the paper P to the upstream side in the transport direction at the time of recording. At this time, the first flap 40 is dropped by its own weight. Thus, the front end (an upstream end in the transport direction when the front surface is recorded) in the transport direction of the paper P is not guided to the second feeding roller pair in the connection point A, but is guided and entered in the reverse path 51.

At this time, the sensor 8 detects the front end in the transport direction of the paper P. This is for the purpose of judging whether or not the paper jam occurs at the time of the reverse transportation of the paper P from the length information of the paper P obtained from the calculation.

In addition, the size V1 of the transport speed of the paper P by the discharging roller pair 39 and the transport roller pair 30 when the paper P is reversely transported is the size of the speed of a state in which the third motor M3 is driven at the highest speed.

Herein, the transport speed refers to the speed at which the roller transports the paper, i.e. the distance transported per unit time.

In addition, the discharging roller pair 39 and the transport roller pair 30 are driven for the reverse rotation and the first reverse roller pair 48 to the third reverse roller pair 50 also start to be driven. The sizes of the transport speed of the first reverse roller pair 48 to the third reverse roller pair 50 are V1 which is the same as those of the discharging roller pair 39 and the transport roller pair 30.

Figure 6:
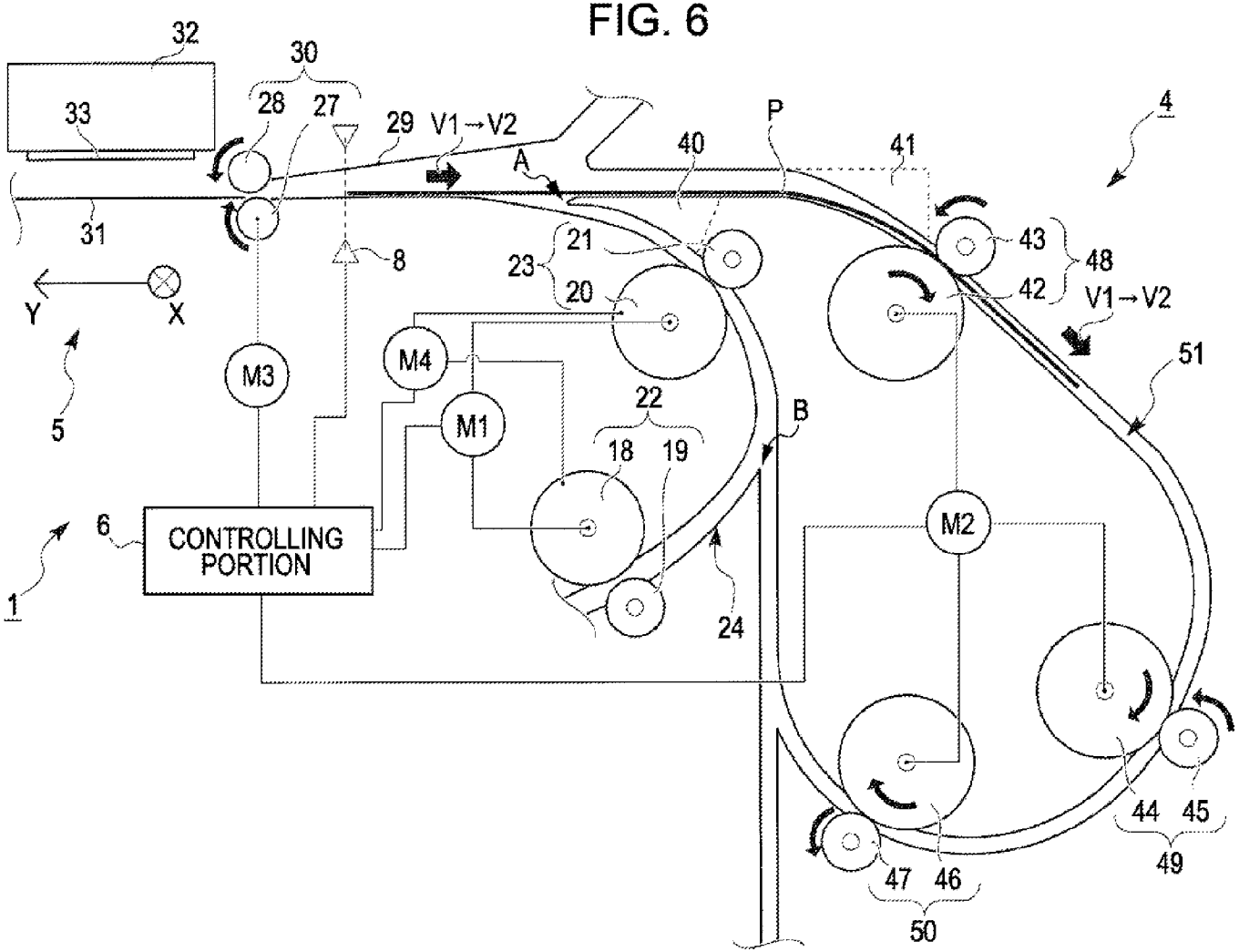
FIG. 6 is a diagram that shows a state in which the printer detects a rear end in the movement direction at the time of a reverse transportation of the paper.

FIG. 6 is a schematic side view that shows a state in which the printer according to an embodiment of the invention detects the rear end in the movement direction when the paper is reversely transported.

As shown in FIG. 6, the first reverse roller pair 48 further transports the paper P from the state shown in FIG. 5 to the upstream side in the transport direction at the time of recording so as to retreat the paper P from the paper guide path 24 to the reverse path 51. At this time, the sizes of the transport speed of the transport roller pair 30 and the first reverse roller pair 48 are V1. At this time, the sensor 8 detects the rear end in the movement direction of the paper P.

In addition, the controlling portion 6 is installed such that it can calculate the distance of the paper P transported by the transport roller pair 30 and the first reverse roller pair 48 from when the front end of the movement direction of the paper P has been detected and to when the rear end in the movement direction of the paper P is detected.

Namely, the controlling portion 6 is installed so as to calculate the length of the paper P twice. The length of the paper P can be hereby reconfirmed.

When the length of the paper P is initially calculated, in a case where the downstream side in the transport direction of the paper P at the time of recording of the paper P protrudes from the printer 1, the user may not accurately calculate the length of the paper P due to an erroneous contact with the paper P, therefore the reconfirm is preferable. In a case where the first calculated value is different from the second calculated value, it may be processed as an error. Furthermore, the "first transport time reduction mode" may continue by setting the second calculated value as a positive value and without processing as an error.

In addition, the controlling portion 6 is configured so as to determine the timing at which the succeeding paper P is transported to the downstream side in the transport direction based on the length information of the calculated paper P.

In addition, in a case where the first calculated value is different from the second calculated value, it is needless to say that the timing may be determined by using the second calculated value as a positive value.

In addition, when the record is performed while the paper P is transported by the transport roller pair 30, in a case where the first feeding driving roller 18 is separated from the first feeding driven roller 19, of course, the first feeding driving roller 18 is caused to reach the first feeding driven roller 19. In a related case, it is needless to say that the second feeding driving roller 20 is also caused to reach the second feeding driven roller 21.

Figure 7:
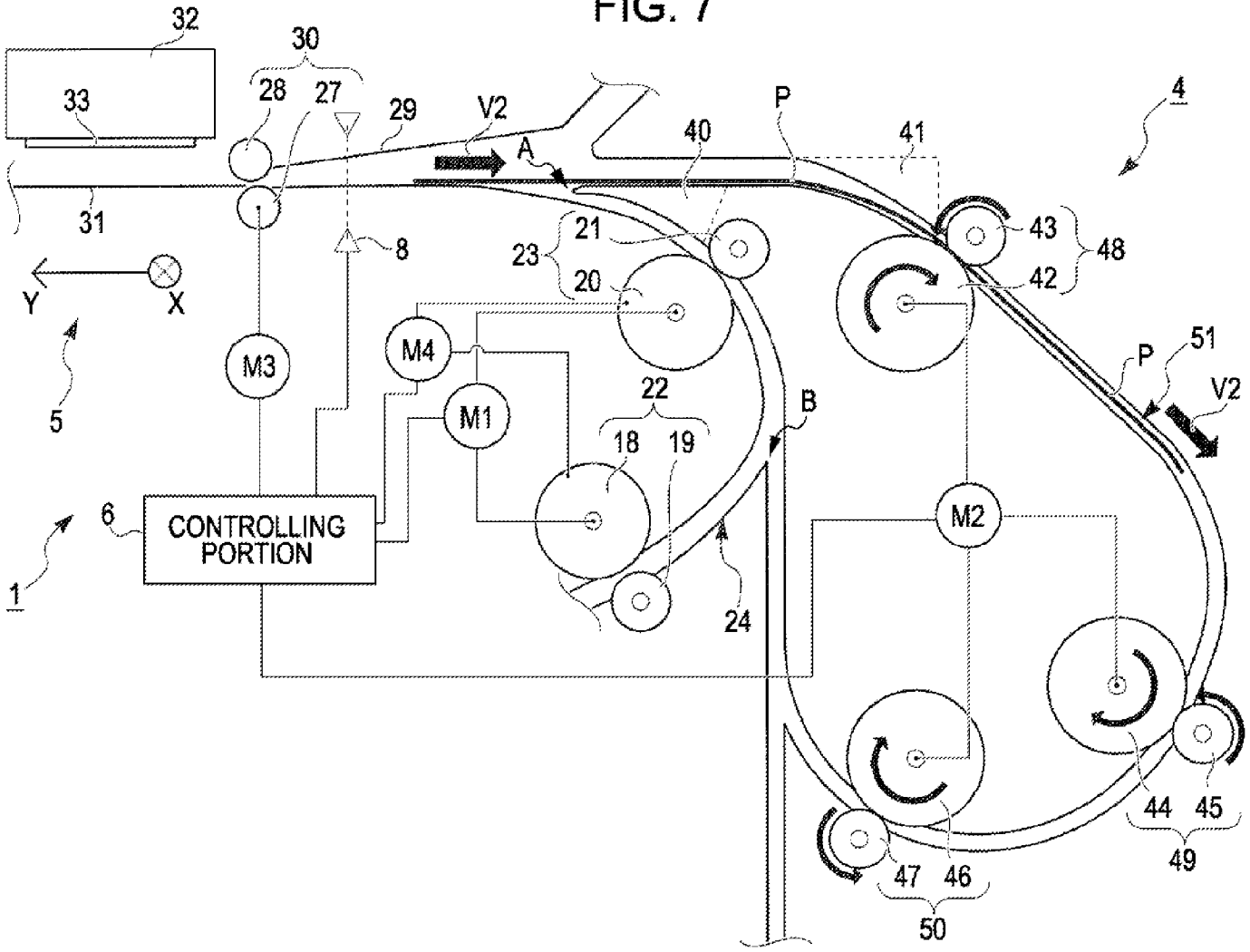
FIG. 7 is a diagram that shows a state in which the printer switches the reverse transportation of the paper to a high speed.

FIG. 7 is a schematic side view that shows a state in which the printer according to an embodiment of the invention switches the reverse transport of the paper to high speed.

As shown in FIG. 7, when the paper P is further transported from the state shown in FIG. 6, the paper P is transported such that it is retreated from the paper guide path 24 to the reverse path 51 by the first reverse roller pair 48. At this time the size of the transport speed of the paper P is configured such that it is accelerated to V2 higher than V1.

Specifically, is the controlling portion 6 judges that the rear end in the transport direction of the paper P passes through the sensor 8, it accelerates the driving speed of the second motor M2. Furthermore, the sizes of the transport speeds of the first reverse roller pair 48 to the third reverse roller pair 50 is set to be V2 higher than V1. Namely, the paper P which has moved at the transport speed V1 is accelerated to the transport speed V2.

At this time, since the rear end in the transport direction of the paper P already passes through the transport roller pair 30, by increasing the transport speeds of the first reverse roller pair 48 to the third reverse roller pair 50, the transport speed of the paper P can be increased. As a result, the loss of time can be reduced.

In addition, it has been configured such that when the rear end in the transport direction of the paper P has passed the sensor 8, the paper P starts to accelerate up to the transport speed V2, however, it of course may be configured such that when the rear end in the transport direction of the paper P has passed through the transport roller pair 30, the paper P starts to accelerate. On the basis of the length of the first calculated paper P and the amount of transport from when the sensor 8 detects the front end of the transport direction of the paper P at the time of the reverse transport, the position of the rear end in the transport direction of the paper P can be calculated. Thus, it is possible to judge whether the rear end in the transport direction of the paper P passes through the transport roller pair 30. In the related case, the loss of the time can be further reduced.

Herein, the transport speed V1 is a transport speed when the third motor M3 is at the highest speed. On the other hand, the transport speed V2 is a transport speed when the second motor M2 is at the highest speed. This can be realized by using, as the second motor M2, a type of motor, which is larger and stronger than the third motor M3.

In addition, the third motor M3 is installed at a minimum size in order to make the size of the printer main body as small as possible. For that reason, it is required that the transport speed V1 cannot be higher than the transport speed V2.

Figure 8:
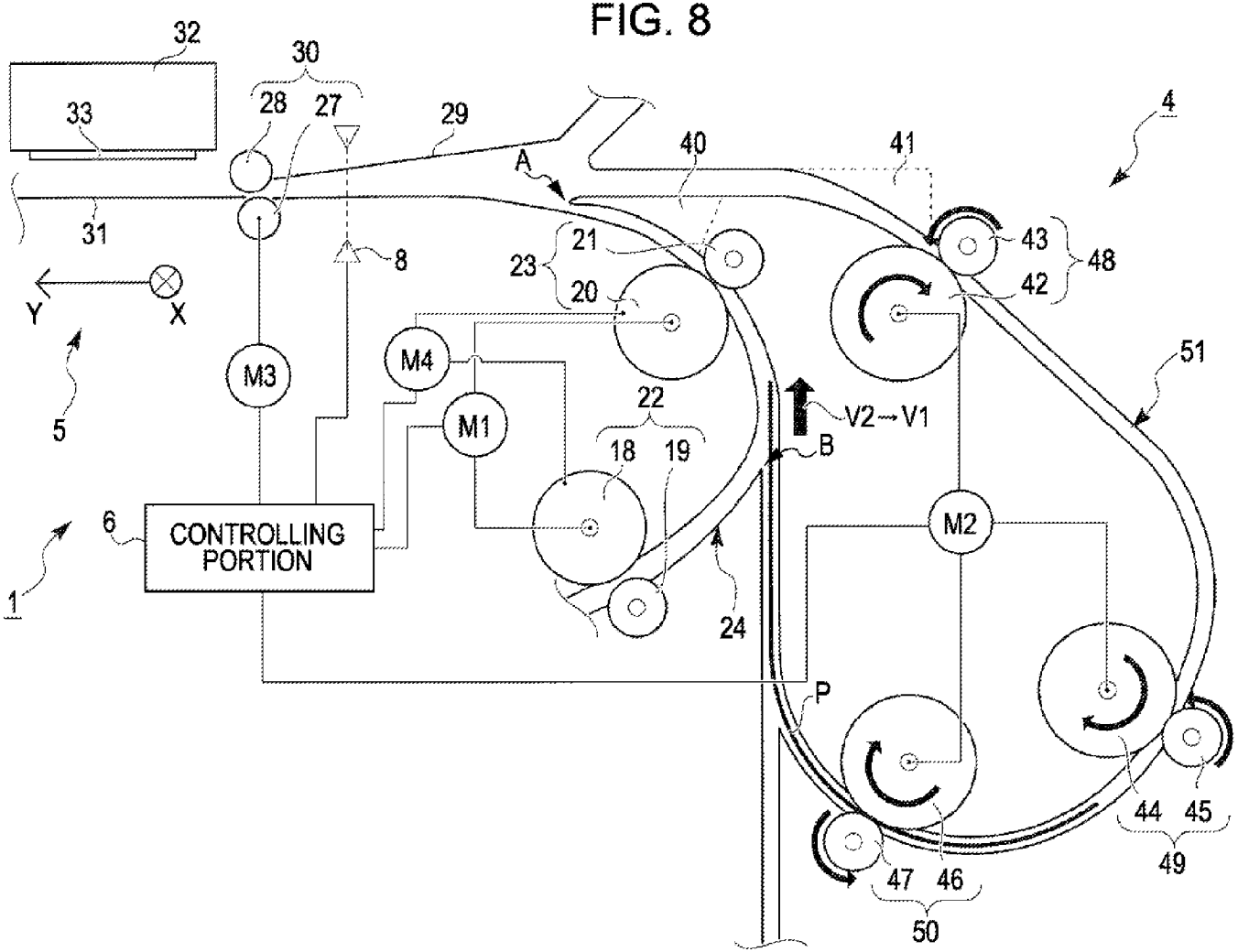
FIG. 8 is a diagram that shows a state in which the printer starts to reduce the reverse transportation of the paper to a low speed.

FIG. 8 is a schematic side view that shows a state in which the printer of an embodiment of the invention starts to reduce the reverse transport of the paper to the low speed.

As shown in FIG. 8, the paper P is transported from the state shown in FIG. 7 such that it is retreated from the paper guide path 24 to the reverse path 51 by the first reverse roller pair 48. Thus, the rear end in the transport direction of the paper P becomes a completely saved from the paper guide path 24 into the reverse path.

In addition, the paper P is further transported by means of the first reverse roller pair 48 to the third reverse roller pair 50, and the front end side in the transport direction of the paper P is returned to the paper guide path 24 from the connection point B which is opposite to the entry side into the reverse path 51. Thereafter, before the front end in the transport direction of the paper P reaches the second feeding roller pair 23, the transport speed of the paper P is reduced from the V2 to V1. This is because the second feeding roller pair 23 is driven at the transport speed V1.

Specifically, the controlling portion 6 judges the position of the front end in the movement direction of the paper P, on the basis of the length information of the calculated paper P and the transported distance of the paper P after the rear end in the movement direction of the paper P has passed through the sensor 8. In addition, by reversely calculating from the time and the distance necessary for reducing from V2 to V1, the second motor M2 is controlled so as to be reduced in front of the second feeding roller pair 23 such that the size of the transport speed becomes V2 until the front end of the paper P reaches the second feeding roller pair 23.

In addition, even if the controlling portion 6 does not perform the above-described reverse calculation, it may of course control the second motor based on the predetermined numerical value.

In addition, similar to the transport roller pair 30, the transport speed V1 of the second feeding roller pair 23 is a transport speed when the first motor M1 is at the highest speed.

In addition, the first motor M1 is installed at a minimum size necessary for making the size of the printer's main body as small as possible. As a result, it is required that the transport speed V2 cannot be higher than the transport speed V1.

Figure 9:
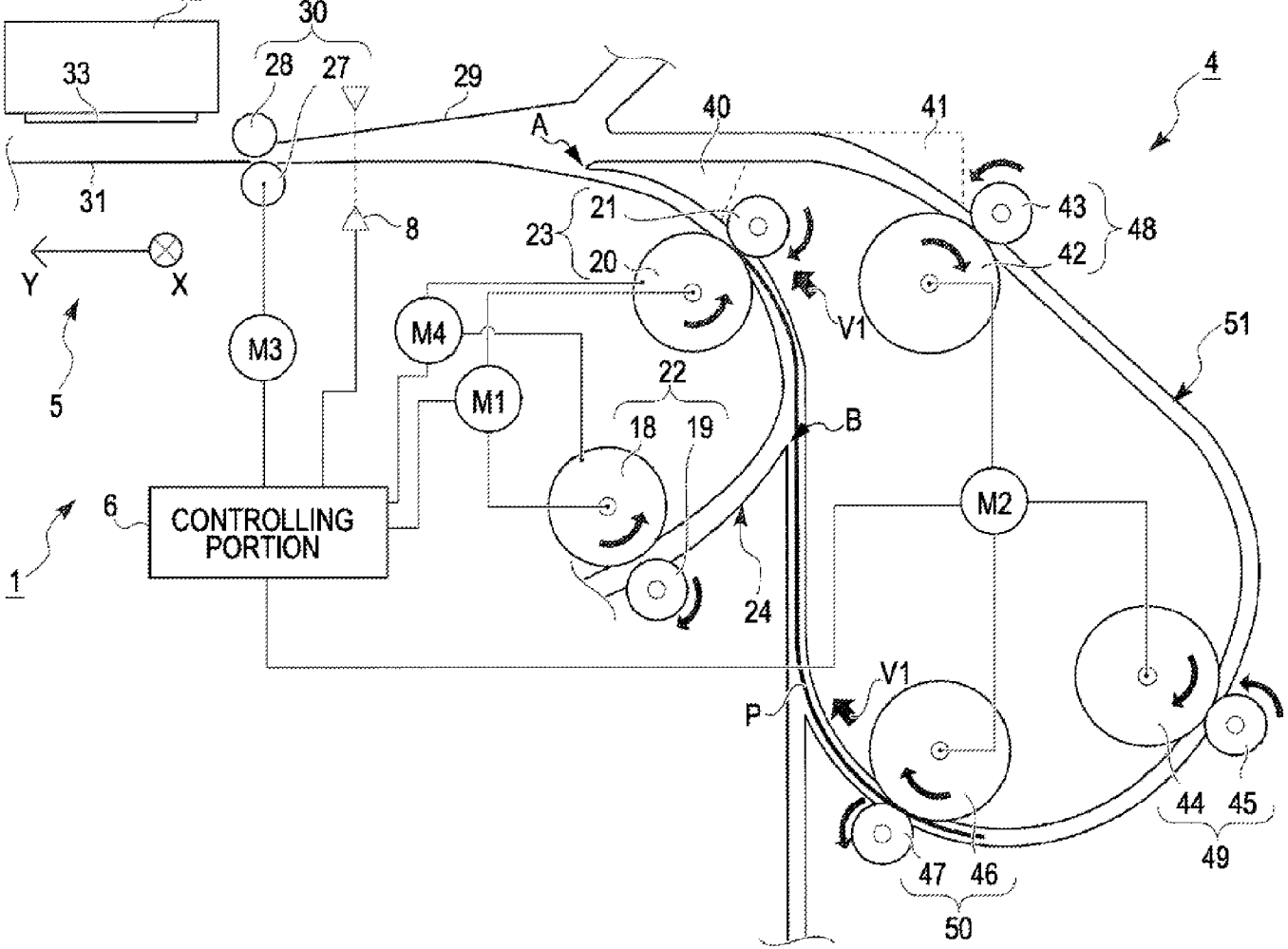
FIG. 9 is a diagram that shows a state in which the printer performs the reverse transportation of the paper at a low speed.

FIG. 9 is a schematic side view that shows a state in which the printer according to an embodiment of the invention performs the reverse transport of the paper at the transport speed V1 (low speed).

As shown in FIG. 9, the paper P is transported from the state shown in FIG. 8 to the second feeding roller pair 23 while the speed thereof is reduced. Furthermore, when the front end in the movement direction of the paper P reaches at least the second feeding roller pair 23, the transport speed of the paper P becomes V1. Thus, it is possible to smoothly transfer the paper P from the third reverse roller pair 50 to the second feeding roller pair 23.

Figure 10:
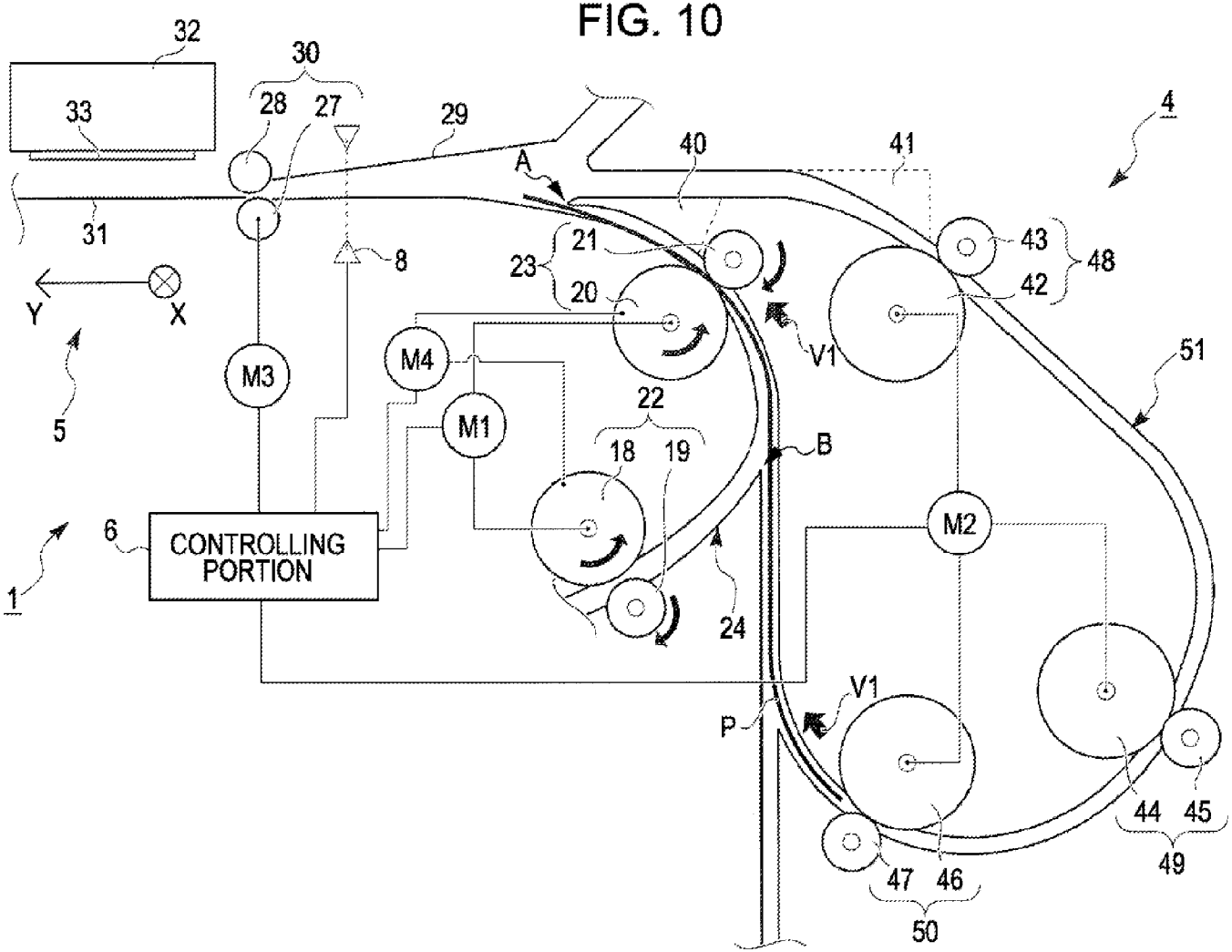
FIG. 10 is a diagram that shows a state in which the printer reverses both sides of the paper and transports the papers to a recording portion.

FIG. 10 is a schematic side view that shows a state in which the printer according to an embodiment of the invention reverses both sides of the paper and transports the paper to the recording portion.

As shown in FIG. 10, the paper P is further transported from the state shown in FIG. 9 to the downstream side of the transport direction. Thus, the front end side in the movement direction of the paper P is pinched by the second feeding roller pair 23. Furthermore, the paper P is transported by the second feeding roller pair 23 at the transport speed V1. At this time, the rear end in the movement direction of the paper P passes through the third reverse roller pair 50. Thereafter, the paper P is transferred from the second feeding roller pair 23 to the transport roller pair 30 and is further transported to the downstream side in the transport direction by the transport roller pair 30.

At this time, the sensor 8 detects the downstream end in the transport direction of the paper P. The controlling portion 6 hereby drives the transport roller pair 30 for the forward rotation. Furthermore, the recording portion 5 is configured so as to perform the record with respect to the rear surface of the paper P.

Thus, in a case where, double-sided recording is performed for the short paper P, to the extent that the transport speed is changed from V1 to V2, as compared to the "normal transport mode", it is possible to reduce the time from when the recording to the front surface of the paper P has been completed to when the recording to the rear surface of the paper P starts. That is to say, the loss of time can be reduced.

In addition, on the basis of time when the sensor 8 detects the downstream end in the transport direction of the paper P, the timing when the succeeding paper P1 is picked up and fed is determined based on the length information of the calculated paper P.

Figure 11:
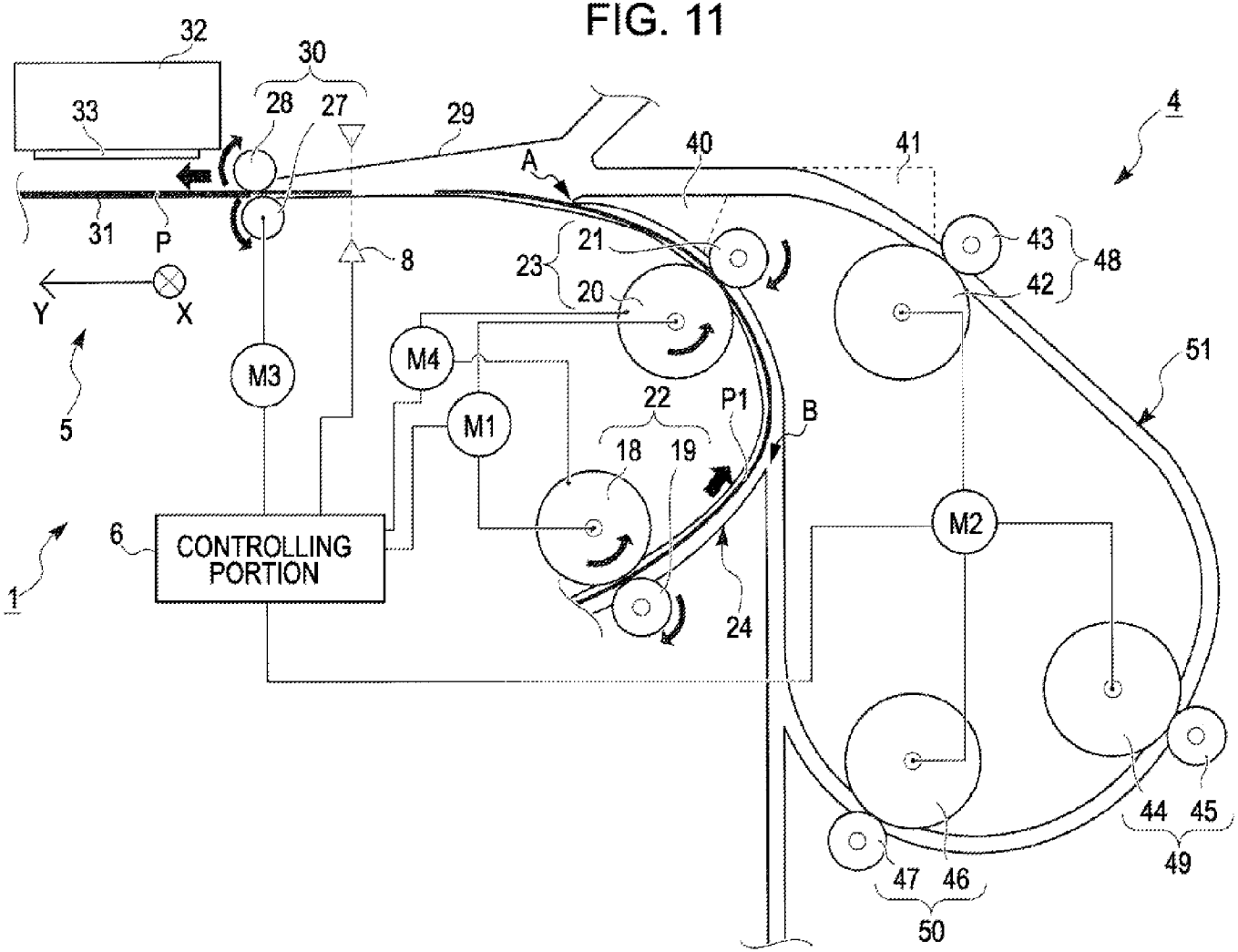
FIG. 11 is a diagram that shows a state in which the printer detects a rear end of a rear surface of the paper.

FIG. 11 is a schematic side view that shows a state in which the printer according to an embodiment of the invention detects the rear end of the paper during recording of the paper.

As shown in FIG. 11, the paper P is transported from the state shown in FIG. 10 to the downstream side in the transport direction at the time of recording by the transport roller pair 30. Furthermore, the rear surface of the paper P is recorded. At this time, the sensor 8 detects the upstream end in the transport direction of the paper P. Thus, similar to when the front surface of the paper P is recorded, the controlling portion 6 can judge whether or not the paper jam occurs.

In addition, in a case where double-sided recording is repeated, the succeeding paper P1 starts to be transported to the downstream side in the transport direction by the pickup roller 17 at the above-described timing. Specifically, the controlling portion 6 starts to transport the paper at the timing in which the distance from the upstream end in the transport direction of the preceding paper P to the downstream end in the transport direction of the succeeding paper becomes as short as possible. Thus, after the recording to the rear surface of the preceding paper P has been completed, the recording to the front surface of the succeeding paper P1 can be immediately started.

In addition, the preceding paper P is discharged to the discharging tray (not shown) by means of the discharging roller pair 39. On the other hand, similar to the preceding roller P, after the front surface of the paper P1 has been recorded, when the paper P1 is moved to the reverses path 51, the succeeding paper P1 is accelerated and transported from V1 to V2. In addition, both sides thereof are reversed and are again returned to the paper guide path 24, the paper P1 is reduced and transported from the transport speed V2 to V1. Thereafter, the rear surface of the paper P1 is recorded.

As described above, in the "first transport time reduction mode", when the paper P is transported in the reverse path 51, the control in which the transport speed is switched from V1 to V2, which is the highest speed, is performed. Thus, in a case where double-sided recording to the short paper P is performed, to the extent that the transport speed is switched from V1 to V2, as compared to the "normal transport mode", it is possible to reduce the time when the recording to the front surface of the paper P has been completed to the time when the recording to the rear surface of the paper P starts.

Figure 12:
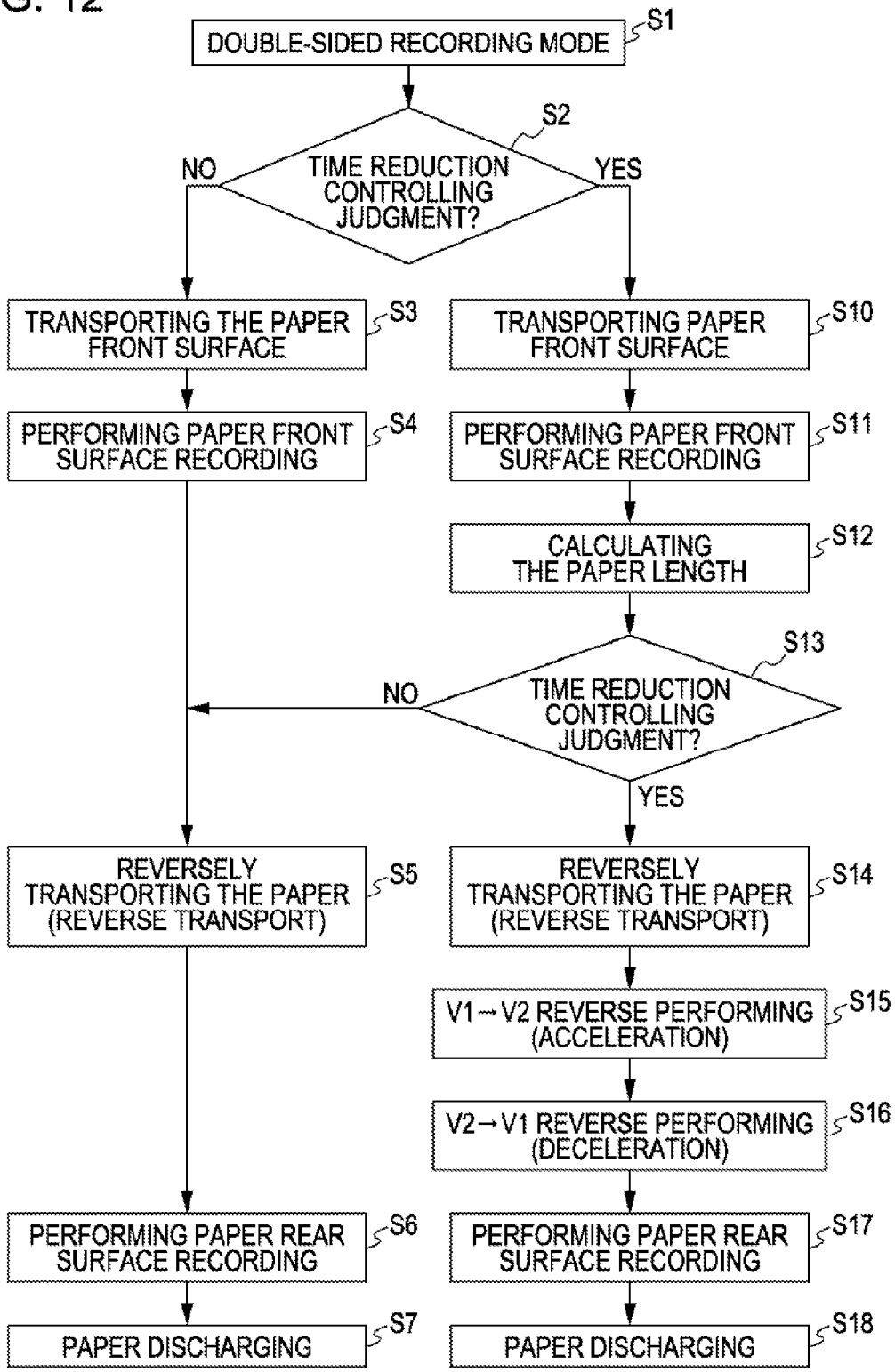
FIG. 12 is a diagram that shows a control of a first transport time reduction mode and a normal transportation mode of the present invention.

FIG. 12 is a diagram that shows the control of double-sided recording mode including the "first transport time reduction mode" and the "normal transport mode" of an aspect of the invention.

As shown in FIG. 12, at step S1, the controlling portion 6 starts the double-sided recording mode.

Herein, the double-sided printing mode refers to a control mode when the front surface and the rear surface of the paper P are recorded.

Furthermore, the process progresses to step S2.

At step S2, the controlling portion 6 performs the time reduction control judgment. Specifically, the user judges whether or not the "first transport time reduction mode" is selected. Furthermore, in a case where it is judged to be negative, i.e. the "normal transport mode" is selected, the process progresses to step S3. In addition, steps S3 to S7 to be described later are the "normal transport modes".

On the other hand, in a case where it is judged that the "first transport time reduction mode" is selected, the process progresses to step S10. Furthermore, steps S10 to S18 to be described later are the "first transport time reduction modes". Among them, steps S10 and S11 are the same as the "normal transport mode".

At step S3, the controlling portion 6 controls the paper P so that the paper P is transported to the downstream end in the transport direction by means of the pickup roller 17, the first feeding roller pair 22 and the second feeding roller pair 23. Furthermore, the process progresses to step S4.

At step S4, the controlling portion 6 controls such that the front surface of the transported paper P is recorded.

Furthermore, the sensor 8 calculates the length of the paper P as described above, and if the length is larger than a predetermined value, it can be of course processed as an error. As a result, it is possible to judge whether or not the paper jam occurs.

Furthermore, the process progresses to step S5.

At step S5, the controlling portion 6 drives the discharging roller pair 39 and the transport roller pair 30 for the reverse rotation so as to reversely transport the paper P in which the front surface has been completed to the upstream side in the transport direction at the time of recording. In addition, the paper P is put into the reverse path 51 from the connection point A, and both sides thereof are reversed in the reverse path 51 while being transported by the first reverse roller pair 48 to the third reverse roller pair 50.

In addition, at this time, it is possible to judge whether or not the paper jam occurs by calculating the length of the paper.

In addition, when the paper P is returned to the paper guide path 24 from the connection point B, the second feeding roller pair 23 and the transport roller pair 30 is driven for the forward rotation and is transported to the downstream side in the transport direction. Furthermore, the process progresses to step S6.

At step S6, the controlling portion 6 controls such that the rear surface of the transported paper P is recorded. Furthermore, the process progresses to step S7.

In addition, at this time, it is possible to judge whether or not the paper jam occurs by calculating the length of the paper. Furthermore, regarding the succeeding paper, it is configured so as to be performed similar to the preceding paper P from step S3.

At step S7, the controlling portion 6 controls such that the paper P in which the rear surface thereof has been completed is discharged by the discharging roller pair 39. That is to say, the preceding paper P in which the recording of both sides thereof has been completed is discharged.

Similar to the above-described step S3, at step S10, the controlling portion 6 controls such that the paper P is transported to the downstream side in the transport direction by means of the pickup roller 17, the first feeding roller pair 22, and the second feeding roller pair 23 (see FIG. 2). Furthermore, the process progresses to step S11.

At step S11, similar to step S4 described above, the controlling portion 6 controls such that the front surface of the transported paper P is recorded (see FIGS. 3 and 4). In addition, the process progresses to step S12.

In addition, at this time, it is possible to judge whether or not the paper jam occurs by calculating the length of the paper.

At step S12, the controlling portion 6 calculates the length of the paper P from information from the sensor 8 and the transported distance of the paper P. It is for the purpose of judging whether or not the "first transport time reduction mode" can be selected. In addition, the process progresses to step S13.

At step S13, the controlling portion 6 judges whether or not the "first transport time reduction mode" can be selected. Specifically, it is judged whether or not the length of the calculated paper P is shorter than the length of the reverse path 51. This is for the purpose of judging whether or not the paper P can be accelerated to the transport speed V2 in the reverse path 51. In the present embodiment, it is judged whether or not the length of the paper P is shorter than the length which enters from the position of the sensor 8 into the reverse path 51 further than the connection point A through the connection point B to the second feeding roller pair 23.

In addition, when it is judged to be short, the process progresses to step 14 for continuously performing the "first transport time reduction mode". On the other hand, when it is judged to be large, the process progresses to step S5 for switching to the "normal transport mode". In a related case, it is because there is no distance to the extent that the paper P is accelerated to the transport speed V2 in the reverse path 51 and "first transport time reduction mode" cannot be performed.

In addition, the value of driver information by the setting of the paper size calculated by the controlling portion 6 may be of course used for the length of the paper P.

At step S14, similar to the above-described step S5, the controlling portion 6 drives the discharging roller pair 39 and the transport roller pair 30 for the reverse rotation, so as to reversely transport the paper P in which the front surface thereof has been completed to the upstream side in the transport direction at the time of recording (see FIGS. 5 to 7). In addition, the paper P is entered from the connection point A to the reverse path 51, and both sides thereof are reversed in the reverse path 51 while being transported by the first reverse roller pair 48 to the third reverse roller pair 50. Furthermore, the process progresses to step S15.

In addition, at this time, it is possible to judge whether or not the paper jam occurs by calculating the length of the paper.

At step S15, the controlling portion 6 accelerates the transport speeds of the first reverse roller pair 48 to the third reverse roller pair 50 from V1 to V2 (see FIG. 7). Specifically, the controlling portion 6 detects that the rear end in the movement direction of the paper P passes through the sensor 8. At this time, the driving speed of the second motor M2 is increased. Thus, as compared to a case where the transport speed of the paper P is still V1, it is possible to reduce the time from when the recording of the front surface of the paper P has been completed to when both sides of the paper P is reversed and is again transported to the recording portion 5. Furthermore, the process progresses to step S16.

In addition, as described above, it may be configured such that when the rear end in the movement direction of the paper P passes through the transport roller pair 30, the acceleration starts. In a related case, the loss of time can be further reduced.

At step S16, when the paper P is returned from the connection point B to the paper guide path 24, the controlling portion 6 reduces the transport speeds of the first reverse roller pair 48 to the third reverse roller pair 50 from V2 to V1 (see FIGS. 8 and 9). Specifically, as described above, the second motor M2 is controlled such that until the front end in the movement direction of the paper P reaches the second feeding roller pair 23, the transport speed becomes V1. Thus, it is possible to smoothly transfer the paper P from the third reverse roller pair 50 to the second feeding roller pair 23 (see FIG. 10). Furthermore, the process progresses to step S17.

At step S17, similar to the above-described step S6, the controlling portion 6 controls so that the rear surface of the transported paper P is recorded (see FIGS. 10 and 11). In addition, the process progresses to step S18.

In addition, at this time, it is possible to judge whether or not the paper jam occurs by calculating the length of the paper. Furthermore, the succeeding paper is performed from step S10 similar to the preceding paper P.

At step S18, similar to the above-described step S7, the controlling portion 6 controls such that the paper P in which the recording of the rear surface thereof has been completed is discharged by the discharging roller pair 39.

As described above, in the case where the length of the paper P is shorter than the length that enters from the position of the sensor 8 into the reverse transport path further than the connection point A through the connection point B to the second feeding roller pair 23, double-sided recording is performed by means of the "first transport time reduction mode". Thus, to the extent that the transport speed is switched from V1 to V2, as compared to the "normal transport mode", it is possible to reduce the time from when the recording to the front surface of the paper P has been completed to when the recording to the rear surface of the paper P starts. As a consequence, it is possible to reduce a so-called throughput which is a time from the recording start to the discharging per unit number of sheet in double-sided recording.

Figure 13:
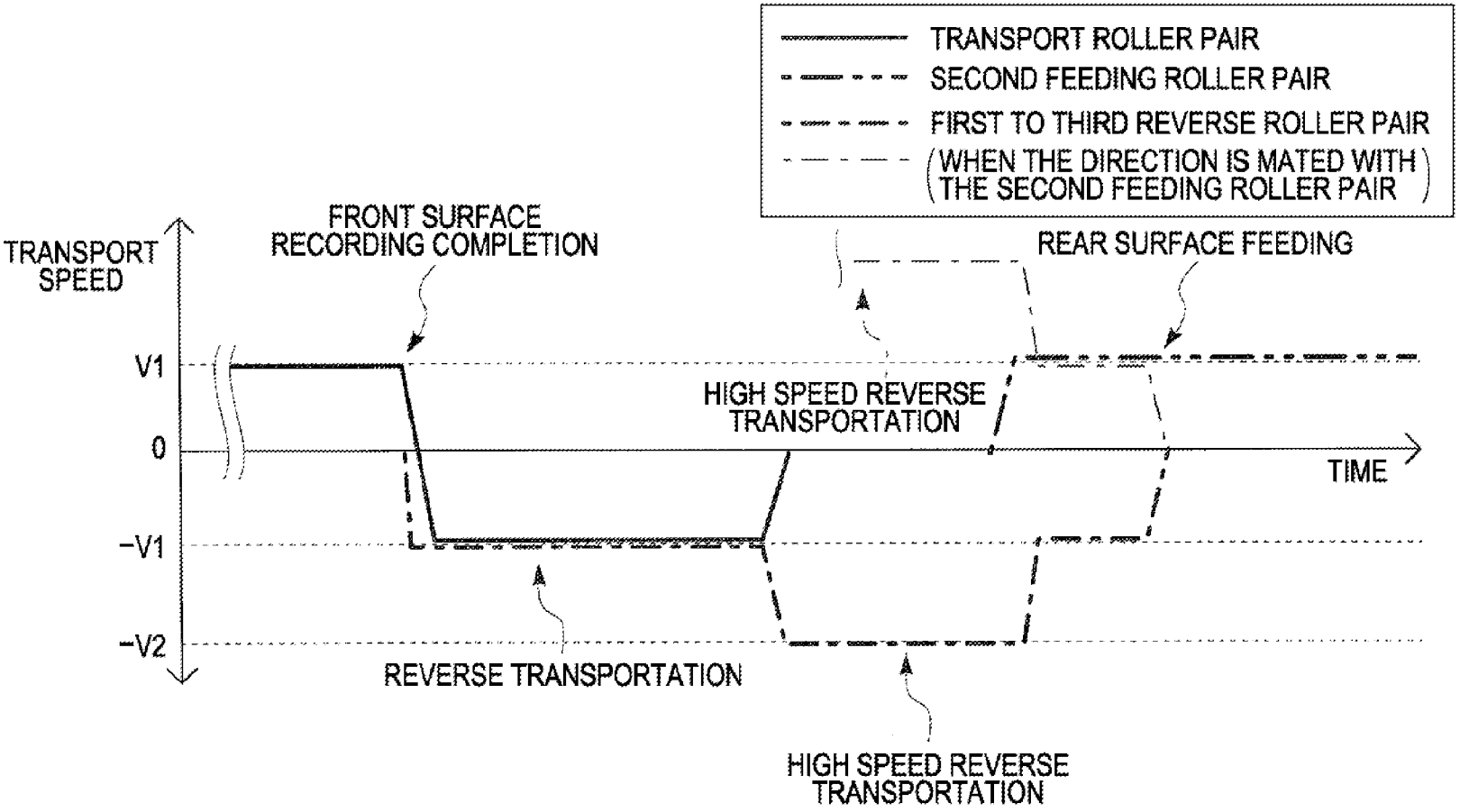
FIG. 13 is a diagram that shows the operations of each roller in the first transport time reduction mode of the invention.

FIG. 13 is a diagram that shows the operation of each roller in the "first transport time reduction mode" of an embodiment of the invention. In FIG. 13, a longitudinal axis represents the transport speed. Herein, with respect to the transport roller pair, the discharging roller pair, and the second feeding roller pair, it is assumed that a speed when the paper moves to the downstream side in the transport direction at the time of recording is a positive speed and a speed when the paper moves to the upstream side in the transport direction at the time of recording is a negative speed. In addition, with respect to the first reverse roller pair to the third reverse roller pair, a speed when the paper moves in such a direction that the paper enters from the connection point A and is returned from the connection point B to the paper guide path is assumed to be a negative speed (dash-dotted line of the thick solid line). In addition, in order to facilitate the understanding of a relationship with the second feeding roller pair, a case where the speed when the paper is moved by means of the first reverse roller pair to the third reverse roller pair is assumed to be a positive speed is indicated by the dash-dotted line of the thin line. On the other hand, the transverse axis represents the time.

As shown in FIG. 13, when the front surface of the paper P is being recorded (see FIG. 3), the controlling portion 6 drives the transport roller pair 30 and the discharging roller pair 39 at the transport speed V1. Furthermore, when the recording to the front surface of the paper P has been completed in case of double-sided recording (see FIG. 4), as described above, the paper P is reversely transported (see FIG. 5). Specifically, the controlling portion 6 drives the transport roller pair 30, the discharging roller pair 39, and the first reverse roller pair 48 to the third reverse roller pair 50 at the transport speed −V1.

At this time, the transport roller pair 30 and the discharging roller pair 39 pinch the paper P. On the other hand, since the first reverse roller pair 48 to the third reverse roller pair 50 do not pinch the paper P, the load is relatively small. As a result, it is possible to set the transport speed −V1 at the timing faster than the transport roller pair 30 and the discharging roller pair 39. Thus, when reversely transporting, it is possible to prevent the occurrence of relaxation in the paper P between the transport roller pair 30 and the first reverse roller pair 48.

In addition, it is preferable that the sizes of the absolute values of the transport speeds of the first reverse roller pair 48 to the third reverse roller pair 50 at this time be slightly larger than the sizes of the absolute values of the transport speeds of the transport roller pair 30 and the discharging roller pair 39. It is because the occurrence of the relaxation in the paper P between the transport roller pair 30 and the first reverse roller pair 48 can be prevented more securely.

In succession, when the rear end in the movement direction of the paper P passes through the sensor 8 (the transport roller pair 30), as described above, the transport speeds of the first reverse roller pair 48 to the third reverse roller pair 50 are changed from −V1 to −V2 (see FIGS. 6 and 7). In other words, the controlling portion 6 controls the second motor M2 such that the paper P is accelerated from the connection point A side toward the connection point B side in the reverse path 51. Furthermore, the size of the absolute value of the transport speed becomes V2 larger than V1. At this time, in order to stop the transport roller pair 30 and the discharging roller pair 39, the controlling portion 6 stops the drive of the third motor M3.

Thereafter, the controlling portion 6 controls the first motor M1 so as to drive the second feeding roller pair 23 at the transport speed V1. This is for the purpose of smoothly transporting the paper P to the recording portion 5 when the paper P with both sides being reversed is transported. Namely, this is for the purpose of preventing the occurrence of the relaxation of the paper P between the third reverse roller pair 50 and the second feeding roller pair 23.

In addition, as described above, until the front end in the movement direction of the paper P reaches the second feeding roller pair 23, the transport speeds of the first reverse roller pair 48 to the third reverse roller pair 50 are changed from −V2 to −V1 (see FIGS. 8 and 9).

That is to say, the controlling portion 6 controls the second motor M2 so that the speed of the paper P to be transported from the connection point B of the reverse path 51 to the second feeding roller pair 23 is reduced.

Furthermore, it is preferable that the sizes of the absolute values of the transport speeds of the second feeding roller pair 23 be slightly larger than sizes of the absolute values of the first reverse roller pair 48 to the third reverse roller pair 50. Because it is possible to more securely prevent the occurrence of the relaxation of the paper P between the third reverse roller pair 50 and the second feeding roller pair 23.

In succession, when the rear end in the movement direction of the paper P passes through the third reverse roller pair 50, in order to stop the first reverse roller pair 48 to the third reverse roller pair 50, the controlling portion 6 stops the drive of the second motor M2 (see FIG. 10).

In addition, the controlling portion 6 can judge whether or not the rear end in the movement direction of the paper P passes through the third reverse roller pair 50 based on the distance of the paper P transported by the first reverse roller pair 48 to the third reverse roller pair 50 from when the sensor 8 detects the rear end in the movement direction of the paper P.

On the other hand, if the front end in the movement direction of the paper P reaches the sensor 8, in order to drive the transport roller pair 30 and the discharging roller pair 39 at the transport speed V1, the controlling portion 6 drives the third motor M3.

Thereafter, the paper P is transported to the downstream side in the transport direction at the time of recording by the transport roller pair 30 and the discharging roller pair 39. Furthermore, the recording to the rear surface of the paper P is performed (see FIG. 11).

In addition, in the above-described embodiment, while three roller pairs (48 to 50) have been installed as the transport means in the reverse transporting portions 4, it is needless to say that the numbers thereof are not limited three.

The printer 1 as the recording apparatus of the present embodiment includes the pickup roller 17 as the first transport unit that transports the paper P, which is an example of the medium to be recorded, to the downstream side in the transport direction, the transport roller pair 30 and the discharging roller pair 39 which is installed in the recording portion side of the downstream in the transport direction at the time of recording from the pickup roller 17 and serves as the second transport unit for transporting the paper P to the upstream side and the downstream side in the transport direction at the time of recording, the paper guide path 24 as the first transport path that guides the paper P between the pickup roller 17 and the transport roller pair 30, the reverse path 51 as the second transport path that reverses both sides of the paper P, the first reverse roller pair 48 to the third reverse roller pair 50 as the third transport unit which is installed on the reverse path, driven by the second motor M2 as the first motor, and transports the paper P, after the front surface as the first surface of the paper P has been recorded by the recording portion 5, the transport roller pair 30 and the discharging roller pair 39 reversely transport the paper P to the upstream side in the transport direction at the time of recording at the speed V1 and put it into the reverse path 51, according to the length of the paper P, after the rear end in the movement direction of the paper P has passed through the transport roller pair 30 and the discharging roller pair 39, the transport speeds of the first reverse roller pair 48 to the third reverse roller pair 50, which are being driven at the transport speed V1, are changed to the transport speed V2 higher than the transport speed V1, the first reverse roller pair 48 to the third reverse roller pair 50 have the first mode that transports the paper P from the retreated side (B), which is opposite to the side (A) put into the reverse path 51, to the recording portion.

Another Embodiment 1

Figure 14:
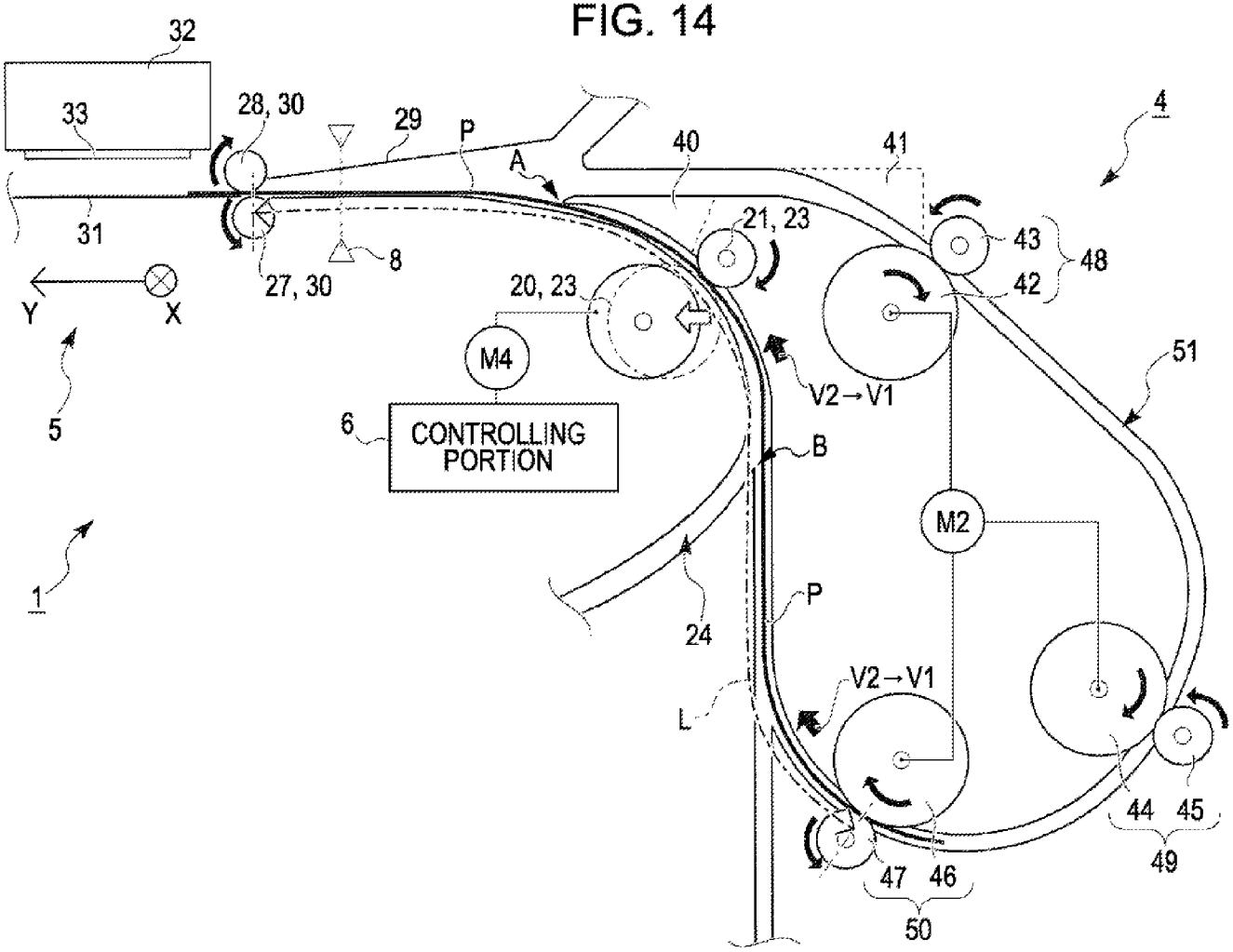
FIG. 14 is a diagram that shows an operation of a second transport time reduction mode in another first embodiment.

FIG. 14 is a schematic embodiment that shows the operation of the "second transport time reduction mode" in another embedment 1.

Furthermore, since each of the members in another embodiment 1 are identical to the above-described embodiment, the same reference numerals are used and the descriptions thereof will be omitted.

In another embodiment 1, the printer 1 has the "first transport time reduction mode" and the "second transport time reduction mode".

Among them, the "first transport time reduction mode" is configured so as to be performed when the length of the paper P is shorter than the path length L from the third reverse roller pair 50 to the transport roller pair 30. Since the "first transport time reduction mode" is identical to the "first transport time reduction mode" of the above-described embodiment, the description thereof will be omitted.

On the other hand, the "second transport time reduction mode" in another embodiment 1 is configured so as to be performed when the length of the paper P is shorter than the length, which enters from the position of the sensor 8 into the reverse path further than the connection point A through the connection point B to the second feeding roller pair 23, and is longer than the path length L from the third reverse roller pair 50 to the transport roller pair 30.

Hereinafter, the "second transport time reduction mode" will be described.

As shown in FIG. 14, the fact that after the recording to the front surface of the paper P has been performed, the paper is reversely transported and entered from the connection point A to the reverse path 51, and the transport speed of the paper P in the reverse path 51 is accelerated from V1 to V2 is the same as the above-described embodiment. Hereinafter, the difference will be described.

The controlling portion 6 separates the second feeding driving roller 20 from the second feeding driven roller 21 until the front end in the movement direction of the paper P reaches the second feeding roller pair 23 via the reverse path 51. Furthermore, until the front end (downstream end in the transport direction at the time of recording) in the movement direction of the paper P reaches the sensor 8, the paper P is moved at the transport speed V2.

Specifically, the controlling portion 6 drives the second motor M2 such that the transport speed by the first reverse roller pair 48 to the third reverse roller pair 50 becomes V2. In addition, when the sensor 8 detects the front end in the transport direction of the paper P, in order to drive the transport roller pair 30 and the discharging roller pair 39 at the transport speed V1, the controlling portion 6 drives the third motor M3. At this time, the controlling portion 6 reduces the speed of the second motor M2 such that the transport speed due to the first reverse roller pair 48 to the third reverse roller pair 50 is switched from V2 to V1.

Furthermore, from when the sensor 8 detects the rear end in the movement direction of the paper P, on the basis of the distance of the paper P transported by the first reverse roller pair 48 to the third reverse roller pair 50, the position of the front end in the movement direction of the paper P may be judged so as to start the reduction of speed. Namely, the reduction of speed may be started before the front end in the movement direction of the paper P reaches the sensor 8.

Furthermore, the paper P is smoothly transferred from the third reverse roller pair 50 to the transport roller pair 30. Then, the paper P is transported to the downstream side in the transport direction at the time of recording by means of the transport roller pair 30 and the discharging roller pair 39. In addition, the recording to the rear surface of the paper P is performed.

As described above, when the "second transport time reduction mode" of another embodiment 1 is performed, as compared to the "first transport time reduction mode" of the above-described embodiment", it is possible to take long distance of the paper P transported at the transport speed V2. Thus, it is possible to further reduce the time from when the recording to the front surface of the paper P has been completed to when the recording to the rear surface of the paper P starts to that extent. As a consequence, at the time of double-sided printing, a so-called throughput which is a time from the recording start to the discharging per unit number of paper can be further reduced.

In another embodiment 1, between the retreated side connection point B of the reverse path 51 in the paper guide path 24 and the transport roller pair 30, the second feeding roller pair 23 as the roller pair is installed which is driven by the first motor M1 as the second motor and is capable of being each separated from each other by the power of the fourth motor M4 as the third motor, has the "first transport time reduction mode" performed when the length of the paper P is shorter than the path length L between the third reverse roller pair 50, which is the downstream side in the transport direction of the third transport unit, and the transport roller pair 30, and the "second transport time reduction mode" as the second mode performed when the length of the paper P is larger than the path length L, when the first reverse roller pair 48 to the third reverse roller pair 50 retreat the paper P from the retreated side connection point B of the reverse path 51 to the paper guide path 24 and transports the paper P to the recording portion side, the "first transport time reduction mode" makes the second feeding roller pair 23 approach to each other, the second feeding roller pair 23 transports the paper P, which has been retreated from the retreated side connection point B of the reverse path 51, to the transport roller pair 30 of the recording portion side, the "second transport time reduction mode" makes the second feeding roller pair 23 separate from each other, and the first reverse roller pair 48 to the third reverse roller pair 50 transports the paper P, which has been retreated from the retreated side connection point B of the reverse path 51, to the transport roller pair 30 of the recording portion side.

Another Embodiment 2

Figure 15:
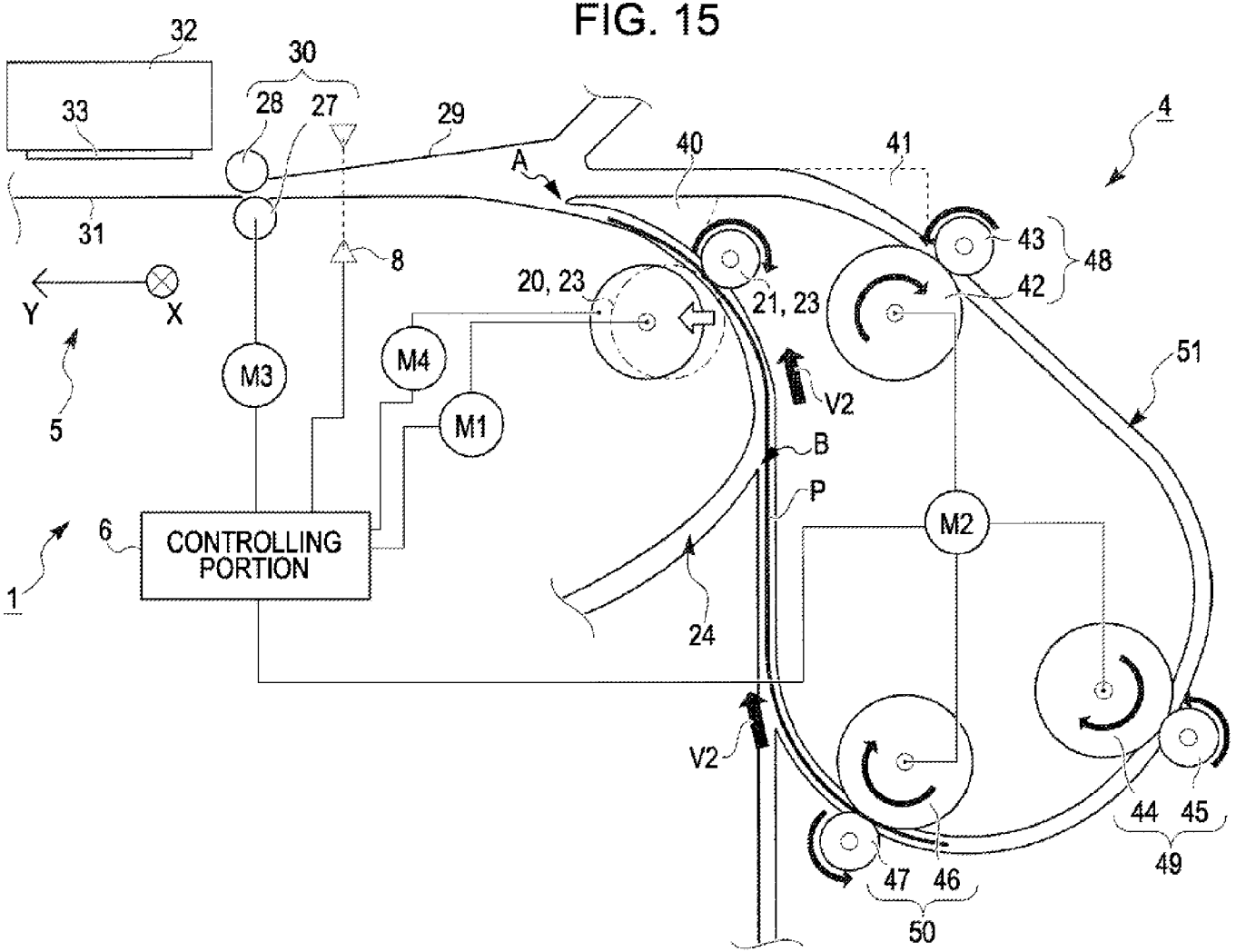
FIG. 15 is a diagram that shows an operation of a third transport time reduction mode in another second embodiment.
Figure 16:
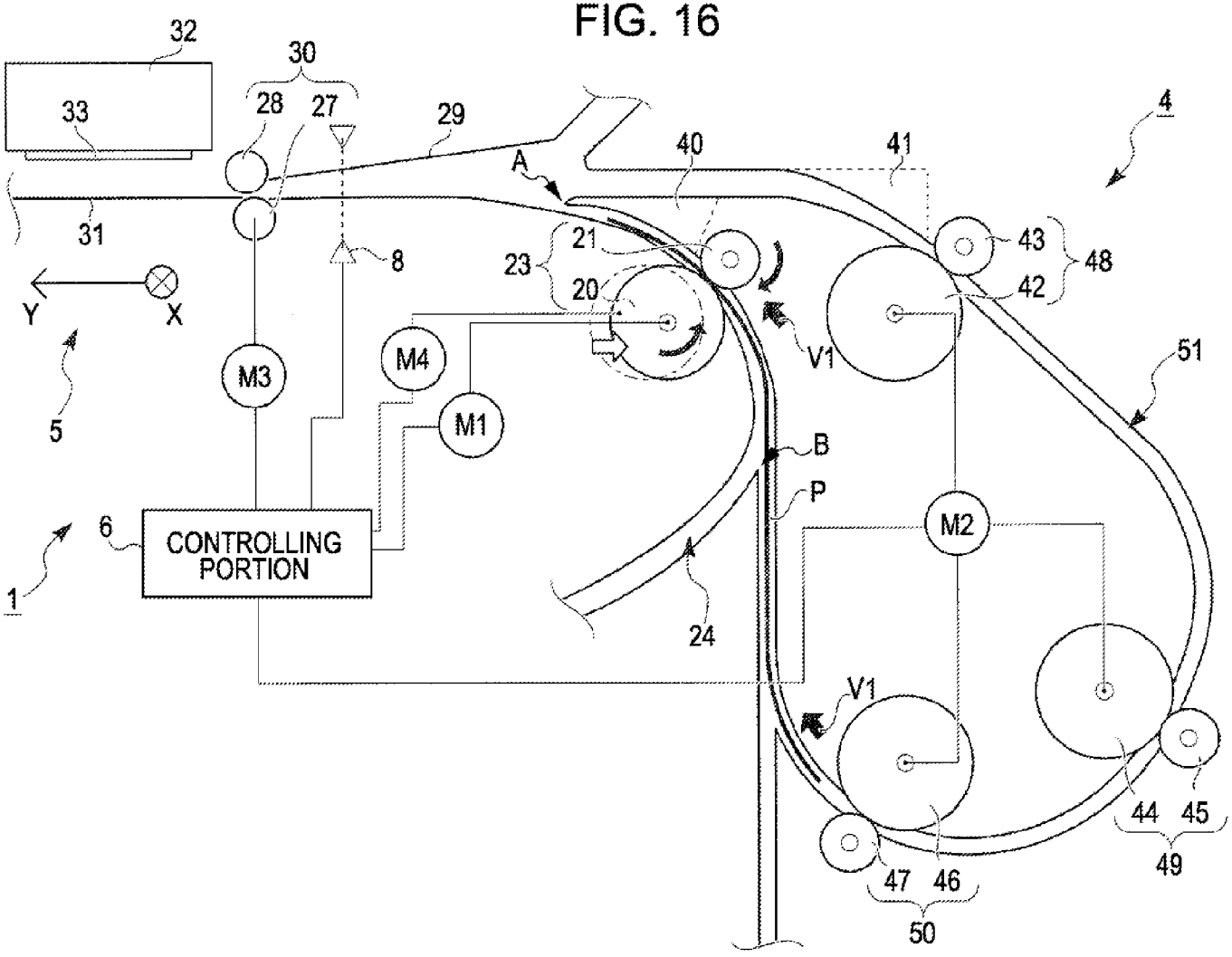
FIG. 16 is a diagram that shows the operation of the third transport time reduction mode in another second embodiment.

FIGS. 15 and 16 are schematic side views that show the operation of the "third transport time reduction mode" in another embodiment 2.

In addition, since each of the members in another embodiment 1 is identical to the above-described embodiment, the members are denoted by the same reference numerals and the descriptions thereof will be omitted.

In another embodiment 2, the printer 1 has a "first transport time reduction mode (quality priority recording mode)", and a "third transport time reduction mode (high speed priority recording mode)".

Among them, the "first transport time reduction mode (quality priority recording mode)" is for the purpose of giving priority to the recording quality as compared to the "third transport time reduction mode (high speed priority recording mode)". The "first transport time reduction mode (quality priority recording mode)" is identical to the "first transport time reduction mode" of the embodiment described above. Thus, the description thereof will be omitted.

On the other hand, the "third transport time reduction mode (high speed priority recording mode)" is for the purpose of further reducing the time from when the recording to the front surface of the paper P has been completed to when the recording to the rear surface of the paper P starts as compared to the "first transport time reduction mode (quality priority recording mode)".

The "third transport time reduction mode (high speed priority recording mode)" in another embodiment 2 is configured so as to be performed when the length of the paper P is shorter than the path length from the third reverse roller pair 50 to the transport roller pair 30 and is larger than the path length from the third reverse roller pair 50 to the second feeding roller pair 23, on the assumption that the length of the paper P is shorter than the length which enters from the position of the sensor 8 into the reverse transport path further than the connection point A through the connection point B to the second feeding roller pair 23.

Hereinafter, the "third transport time reduction mode (high speed priority recording mode)" will be described.

As shown in FIG. 15, the fact that after the recording to the front surface of the paper P has been performed, the paper is reversely transported and is entered from the connection point A to the reverse path 51 and the transport speed of the paper P in the reverse path 51 is accelerated from V1 to V2 is the same as the above-described embodiment. Hereinafter, the difference will be described.

Until the front end in the movement direction of the paper P reaches the second feeding roller pair 23 via the reverse path 51, the controlling portion 6 separates the second feeding driving roller 20 from the second feeding driven roller 21. In addition, until the rear end in the movement direction of the paper P passes through the third reverse roller pair 50, the controlling portion 6 moves the paper P at the transport speed V2. Specifically, the controlling portion 6 drives the second motor M2 such that the transport speed V2 due to the first reverse roller pair 48 to the third reverse roller pair 50 becomes V2.

In addition, as shown in FIG. 16, when the rear end in the movement direction of the paper P has passed through the third reverse roller pair 50, the controlling portion 6 drives the first motor M1 in order to transport the paper P at the transport speed V1 with the second feeding roller pair 23. Furthermore, the fourth motor M4 is driven to move the second feeding driving roller 20 close to the second feeding driven roller 21.

Herein, on the basis of the distance of the paper P transported by the first reverse roller pair 48 to the third reverse roller pair 50 from when the sensor 8 detects the rear end in the movement direction of the paper P, it is possible to judge whether or not the rear end in the movement direction of the paper P passes through the third reverse roller pair 50.

Thus, the second feeding roller pair 23 can press the middle portion between the front end and the rear end in the movement direction of the paper P and transport the paper P to the downstream side in the transport direction at the time of recording at the transport speed V1. That is to say, when the front end in the movement direction of the paper P passes through the second feeding driven roller 21, the paper P is not pressed by the second feeding roller pair 23.

At this time, the paper P is transported at the transport speed V2 by the third reverse roller pair 50. Thus, in the "third transport time reduction mode (high speed priority recording mode)", it is possible to lengthen the distance of the paper P transported at the transport speed V2 as compared to the "first transport time reduction mode (quality priority recording mode)". As a result, it is possible to further reduce the time from when the recording to the front surface of the paper P has been completed to when the recording to the rear surface of the paper P starts to that extent.

In addition, when the front end in the movement direction of the paper P passes through the sensor 8, in order to drive the transport roller pair 30 and the discharging roller pair 39 at the transport speed V1, the controlling portion 6 drives the third motor M3. Furthermore, the controlling portion 6 stops the second motor M2 so as to stop the first reverse roller pair 48 to the third reverse roller pair 50.

Thus, it is possible to transfer the paper P from the second feeding roller pair 23 to the transport roller pair 30.

Thereafter, the paper P is transported to the downstream side in the transport direction at the time of recording by means of the transport roller pair 30 and the discharging roller pair 39. Furthermore, the recording to the rear surface of the paper P is performed.

In addition, in the "first transport time reduction mode (quality priority recording mode)", the second feeding roller pair 23 which is driven at the transport speed V1 receives the paper P which has been transported from the third reverse roller pair 50 at the transport speed V1, thus there is no fear of an occurrence of a roller print on the paper P as compared to the "third transport time reduction mode (high speed priority recording mode)".

In another embodiment 2, between the retreated side connection side B of the reverse path 51 in the paper guide path 24 and the transport roller pair 30, the second feeding roller pair 23 as the roller pair is installed which is driven by the first motor M1 and can be separated from each other by the power of the fourth motor M4, in addition to the "first transport time reduction mode (quality priority recording mode)", the apparatus has the "third transport time reduction mode (high speed priority recording mode)" as the third mode, when the first reverse roller pair 48 to the third reverse roller pair 50 retreat the paper P from the retreated side connection side B of the reverse path 51 to the paper guide path 24 and transport the paper P to the recording portion, the "first transport time reduction mode (quality priority recording mode)" drives the second feeding roller pair 23 in a mutually approached state at the transport speed V1, and before front end in the movement direction of the paper P reaches the second feeding roller pair 23, the transport speed V2 of the first reverse roller pair 48 to the third reverse roller pair 50 is changed to the transport speed V1, the "third transport time reduction mode (high speed priority recording mode)" drives the second feeding roller pair 23 in a mutually separated state at the transport speed V1, until the rear end in the movement direction of the paper P passes through the first reverse roller pair 48 to the third reverse roller pair 50, the first reverse roller pair 48 to the third reverse roller pair 50 is driven at the transport speed V2, and after the front end in the movement direction of the paper P has passed through the second feeding roller pair 23, the second feeding roller pair 23 is approached to each other.

In addition, the invention is not limited to the above-described embodiment, but can be variously changed within the scope of the invention described in the claims, and the same is also included within the scope of the invention.

What is claimed is:

1. A recording apparatus comprising:

a main body;

a medium mounting portion that mounts a medium and is arranged in the main body;

a pickup roller that feeds the medium from the medium mounting potion and is arranged in the main body;

a recording portion that records on the medium and is arranged in the main body;

a straight path that extends from the recording portion to a rear opening of the main body and past a flap provided in the main body;

a first medium guide path that connects to the straight path and guides a medium from the medium mounting portion toward the flap, a portion of the straight path upstream of the recording potion, and then to the recording portion, the first medium guide path reverses the medium transported from the medium mounting portion;

a second medium guide path that reverses the medium recorded by the recording portion and transports the medium recorded to the recording portion past the flap; and a moveable member that is moveable in a direction away from a set position, the moveable member being installed in the main body, wherein a portion of the straight path is formed between the main body and the moveable member, wherein a portion of the first medium guide path is formed between the main body and the moveable member, wherein a portion of the second medium guide path is formed between the main body and the moveable member, wherein when the moveable member is moved away from the set position, a portion of the main body side of the straight path, a portion of the main body side of the first medium guide path and a portion of the main body side of the second medium guide path are uncovered by the moveable member.

2. The recording apparatus according to claim 1, further comprising a driving roller is arranged in the first medium guide path of a side of the main body, and a driven roller is arranged in the first medium guide path of a side of the moveable member.

3. The recording apparatus according to claim 1, when the moveable member moves off the set position, a part of a first connection point between the straight path and the first medium guide path is exposed by the moveable member.

4. The recording apparatus according to claim 1, when the moveable member moves off the set position, a part of a second connection point between the first medium guide path and the second medium guide path is exposed by the moveable member.

* * * * *